US007256168B2

(12) United States Patent
Raehse et al.

(10) Patent No.: US 7,256,168 B2
(45) Date of Patent: Aug. 14, 2007

(54) WASHING OR CLEANING AGENT SHAPED BODIES

(75) Inventors: Wilfried Raehse, Duesseldorf (DE); Rolf Bayersdoerfer, Duesseldorf (DE); Paul Birnbrich, Solingen (DE); Markus Semrau, Timmaspe (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 849 days.

(21) Appl. No.: 10/276,777

(22) PCT Filed: May 8, 2001

(86) PCT No.: PCT/EP01/05193

§ 371 (c)(1),
(2), (4) Date: Mar. 18, 2003

(87) PCT Pub. No.: WO01/88079

PCT Pub. Date: Nov. 22, 2001

(65) Prior Publication Data

US 2004/0053808 A1 Mar. 18, 2004

(30) Foreign Application Priority Data

May 17, 2000 (DE) ..... 100 24 261
Feb. 16, 2001 (DE) ..... 101 07 217

(51) Int. Cl.
*C11D 17/00* (2006.01)
*C11D 11/00* (2006.01)
*C11D 3/37* (2006.01)

(52) U.S. Cl. ..... 510/446; 510/224; 510/294; 510/298; 510/455

(58) Field of Classification Search ..... 510/446, 510/224, 294, 298, 455
See application file for complete search history.

(56) References Cited

U.S. PATENT DOCUMENTS

| | | | | |
|---|---|---|---|---|
| 2,210,924 A | | 8/1940 | Hood | |
| 2,269,871 A | * | 1/1942 | De Botelho | 401/8 |
| 2,525,081 A | | 10/1950 | Schulerud | |
| 3,234,258 A | | 2/1966 | Morris | |
| 3,359,206 A | | 12/1967 | Cratsa | |
| 4,328,131 A | * | 5/1982 | Carson et al. | 510/145 |
| 5,075,041 A | | 12/1991 | Lutz | |
| 5,194,172 A | | 3/1993 | Taneri et al. | |
| 5,895,780 A | | 4/1999 | Tokosh et al. | |
| 6,106,849 A | * | 8/2000 | Malkan et al. | 424/401 |
| 6,274,538 B1 | * | 8/2001 | Addison | 510/224 |
| 7,056,877 B2 | * | 6/2006 | Caswell et al. | 510/439 |

FOREIGN PATENT DOCUMENTS

| | | | |
|---|---|---|---|
| DE | 2 115 912 | | 10/1972 |
| DE | 27 38 072 | A1 | 3/1979 |
| DE | 197 10 254 | A1 | 9/1998 |
| DE | 197 09 991 | C2 | 12/1999 |
| DE | 198 26 430 | A1 | 12/1999 |
| EP | 0 006 200 | A1 | 1/1980 |
| EP | 0 090 648 | A1 | 10/1983 |
| EP | 0 711 826 | A2 | 5/1996 |
| GB | 978 192 | | 12/1964 |
| GB | 1307387 | A * | 2/1973 |
| JP | 59-179635 | | 10/1984 |
| JP | 11-043699 | | 2/1999 |
| WO | WO 98/40463 | A1 | 9/1998 |
| WO | WO 99/06522 | A1 | 2/1999 |
| WO | WO 99/24547 | A1 * | 5/1999 |
| WO | WO 99/27063 | A1 | 6/1999 |
| WO | WO 99/27067 | A1 | 6/1999 |

OTHER PUBLICATIONS

Derwent Publications Ltd., Class D25, AN 1999-199183, XP002175794 (JP 11 043699).
Derwent Publications Ltd., Class A17, AN 1984-291459, XP002175795 (JP 59 179635).
CFTA International Cosmetic Ingredient Dictionary and Handbook, 5th Edition, The Cosmetic, Toiletry and Fragrance Association, Washington, (1997).
G. Jakobi et al., "Detergents and Textile Wasing", VCH-Verlag, Weinheim, p. 94 (1987).

* cited by examiner

*Primary Examiner*—Lorna M. Douyon
(74) *Attorney, Agent, or Firm*—John S. Child, Jr.

(57) ABSTRACT

A detergent tablet having at least one phase in the form of a solid foam having gas-filled cells delimited by solid partitions, and the tablet or the at least one phase comprises 40% to 90% by weight of one or more water-soluble polymers. A process for the production of detergent tablets by foaming a solution, melt, emulsion, or suspension comprising at least one active ingredient with a gaseous medium, and solidifying the resulting foam.

83 Claims, No Drawings

WASHING OR CLEANING AGENT SHAPED BODIES

CROSS-REFERENCE TO RELATED APPLICATIONS

This application is a U.S. National Stage application filed under 35 U.S.C. § 371, claiming priority under 35 U.S.C. § 365 of International Application No. PCT/EP01/05193, filed May 8, 2001 in the European Patent Office, and claiming priority under 35U.S.C. § 119 of DE 100 24 261.8, filed May 17, 2000, and DE 101 07 217.1, filed Feb. 16, 2001 in the German Patent Office.

BACKGROUND OF THE INVENTION

This invention relates to detergent tablets with a novel structure.

Detergent tablets are widely described in the prior-art literature and, by virtue of the advantages they offer, have been successful both commercially and with consumers.

The production of detergent tablets normally comprises preparing particulate premixes which are then tabletted by tabletting techniques known to the expert. Unfortunately, this method of production has distinct disadvantages because pressure-sensitive ingredients can be damaged during the production process. Hitherto, it has not been possible to incorporate these ingredients, for example encapsulated enzymes, etc., in tablets without losses of activity. In some cases, instability or complete inactivity could even be expected.

In addition, the supply form of the compressed tablet means that the ingredients are in direct physical proximity to one another which, in the case of mutually incompatible substances, leads to unwanted reactions, instability, inactivity or loss of active ingredient.

Another effect of the high compaction in this supply form is that solubility diminishes. Generally, there is a dichotomy between sufficient hardness (i.e. handling resistance during packaging, transportation and use) and sufficiently high disintegrating and dissolving rates.

To solve the problems mentioned above, it has been proposed in the prior art to produce multiphase tablets where several layers are pressed onto one another. Any incompatibility between ingredients should be negated by separation. Unfortunately, this has the disadvantage that the lower layers are exposed to much higher compression which results in reduced solubility. In addition, the problems mentioned were not fully solved in this way because tablets with more than three layers cannot be produced with reasonable outlay on equipment.

Another attempted solution is disclosed in International patent applications WO 99/06522, WO 99/27063 and WO 99/27067. In these documents, it is proposed to produce tablets of compressed and non-compressed portions and to incorporate pressure-sensitive substances in the non-compressed portions. Here, too, however, the problems posed by the simultaneous incorporation and separation of several pressure-sensitive ingredients are not solved.

In addition, there is the problem that pressure- and temperature-sensitive ingredients cannot be incorporated without losses of active ingredient even by the teaching of these documents, because the non-compressed portions are incorporated in the tablets via the melt phase. The visual originality of the tablets produced in accordance with the teaching of the documents in question is also poor which does not increase consumer acceptance in relation to conventional tablets. Proposals to improve the solubility of the individual phases are confined in those prior-art documents to the conventional methods of incorporating disintegrators or reducing the hardness of the compressed portions.

Accordingly, there was still a need to provide improved detergent tablets which would combine a very high degree of mechanical stability with good solubility and which would allow economic production and the incorporation of pressure-sensitive ingredients, even in the case of tablets having more than three phases. The supply form to be developed would ensure high consumer acceptance not only through its technical advantages but also through its visual originality.

It has now been found that it is possible to produce detergent tablets which completely or partly have structures of solid foams and which combine a high level of mechanical stability with greatly improved solubility and a completely novel appearance.

In a first embodiment, therefore, the present invention relates to detergent tablets comprising solid(s) and gas(es) and optionally other detergent ingredients, characterized in that the tablet consists of gas-filled cells (pores) delimited by solid partitions.

In another embodiment, the present invention relates to multiphase detergent tablets where at least one phase of the tablet comprises solid(s) and gas(es) and optionally other detergent ingredients, this phase consisting of gas-filled cells (pores) delimited by solid partitions.

According to the invention, therefore, the entire tablet or at least one phase of multiphase tablets consists of gas-filled cells (pores) which are delimited by solid partitions. Such structures may also be referred to simplistically as "solid foams". In connection with the terms "foam" or "partitions of the gas-filled cells", the adjective "solid" refers to the aggregate state of the partition at 25° C./1013.25 mbar. This word relates specifically to the fact that the partitions are no longer liquid under the physical conditions mentioned and encompasses both rigid and flexible walls. Visually, both the flexible polyurethanes foams known as upholstery foam and the rigid polyurethane foams or Styropor® used for sealing in the building industry fall into the category of gas-filled cells delimited by solid partitions.

If the concentration by volume of the gas forming the foam is less than 74% for homodisperse distribution, the gas bubbles are spherical on account of the surface-reducing effect of the interfacial tension. Beyond the close packing limit, the bubbles are deformed to polyhedral lamellae which are defined by ca. 4-600 nm thin skins. The cell walls—joined via by so-called nodal points—form a coherent structure. The foam lamellae extend between the cell walls (closed-cell foam). If the foam lamellae are destroyed or if they flow back into the cell walls at the end of foaming, an open-cell foam is obtained. Foams are thermodynamically unstable because surface energy can be obtained by making the surface smaller. Accordingly, the stability and hence the existence of the foams according to the invention depends on the extent to which it is possible to prevent their self-destruction.

In preferred embodiments, foams can be produced by injecting the gaseous medium into the above-mentioned liquids. Alternatively, foaming can be achieved by intensive beating, shaking, spraying or stirring of the liquid in the particular gas atmosphere. Because it provides for easier foaming and can be better controlled and carried out, foam generation by injection of the gaseous medium ("mechanical blowing") is distinctly preferred to the other variants for the purposes of the present invention. Depending on the required process variant, mechanical blowing takes place continuously or discontinuously via perforated plates, sintered disks, sieve inserts, Venturi nozzles, inline mixers, homogenizers or other standard systems. Self-foaming systems where the foaming gas is formed by chemical reaction of the components with one another are also preferred for the purposes of the invention. Before the foam collapses, the liquid, semiliquid or highly viscous cell walls solidify into solids so that the foam is stabilized and a "solid foam" is formed.

Any gases or gas mixtures may be used as the gaseous medium for foaming. Examples of gases used in the art are nitrogen, oxygen, noble gases and noble gas mixtures, for example helium, neon, argon and mixtures thereof, carbon dioxide, etc. According to the invention, air is preferably used as the gaseous medium for reasons of cost. Providing the components to be foamed are oxidation-resistant, the gaseous medium may even consist entirely or partly of ozone so that impurities or discoloration destroyable by oxidation in the media to be foamed can be eliminated or germ infestation of those components can be prevented.

The tablets according to the invention or the particular phase(s) of the tablets according to the invention may consist of relatively large gas-filled cells with solid cell walls, although the pore size may also be small. Other visually attractive tablets can also be tablets (or parts thereof which, in a "matrix" of many small-diameter gas-filled cells, have a few large cells which stand out clearly as relatively large cavities from the matrix of relatively small cavities at the edges of the tablet (or phase).

Irrespective of the pore size, preferred tablets according to the invention are characterized in that the ratio of the mean diameter of the gas-filled cells to the mean diameter of the solid partitions is at least 1:2, preferably at least 5:1, more preferably at least 10:1 and more particularly more than 20:1.

According to the invention, therefore, relatively large pores and relatively thin partitions are preferred. In absolute terms in respect of the dimensions typical of detergent tablets with diameters and heights of at most a few centimeters, preferred detergent tablets are characterized in that the mean diameter of the gas-filled cells is 0.005 to 5 mm, preferably 0.05 to 0.5 mm and more particularly 0.1 to 0.3 mm.

Other preferred detergent tablets are characterized in that the mean diameter of the solid partitions is between 0.001 and 2 mm, preferably between 0.005 and 0.3 mm and more particularly between 0.01 and 1 mm.

The gas content of a given volume of a tablet according to the invention or of a phase of a tablet according to the invention varies according to the size of the gas-filled pores, the thickness of the cell walls and the quantity of gas or wall material. Preferred detergent tablets are characterized in that the volume of the gas-filled cells makes up at least 50% by volume, preferably at least 60% by volume and more particularly at least 70% by volume of the total volume of the tablet or phase.

Depending on the density of the gas in the gas-filled pores and the density of the cell walls, the detergent tablets according to the invention or one or more phases thereof has/have a certain density which, advantageously, is clearly below the density of conventional tablets produced by press technology. According to the invention, preferred detergent tablets are characterized in that the tablet or the phase has a density of 0.01 to 1.0 $gcm^{-3}$, preferably 0.05 to 0.7 $gcm^{-3}$ and more particularly 0.1 to 0.3 $gcm^{-3}$.

As mentioned above, air is preferably used as the gaseous medium. However, other gases or gas mixtures may be used as the filling of the gas-filled cells. For example, it may be preferred to pass pure oxygen or the air used as filling gas through an ozonizer before the gas is used to fill the pores. Gas mixtures containing, for example, 0.1 to 4% by weight of ozone, for example, may be prepared in this way. The ozone content of the gas then leads to the oxidative destruction of unwanted constituents in the media to be foamed. According to the invention, preferred detergent tablets are characterized in that the gas-filled cells contain one or more gases from the group of noble gases, carbon dioxide, nitrogen, dinitrogen oxide, oxygen, ozone, dimethyl ether and air.

The cell walls of the tablets or tablet phases according to the invention consist of substances or substance mixtures which are solid at 25° C./1013.25 mbar. With inexpensive industrial manufacture in mind, preferred materials for the cell walls are solids which can be converted by dissolution, suspension, emulsification, melting, etc. into a liquid or high-viscosity paste which is then foamed by addition of filling gas (see above), the foam formed preferably being cured by cooling, solvent evaporation, delayed solvent binding, crystallization, chemical reaction (particularly polymerization, polycondensation or polyaddition), changes in the rheological properties or radiation curing.

Accordingly, particularly suitable materials for the cell walls are polymers which either are foamed in the form of concentrated solutions or suspensions or are only formed from their monomers during the foaming process. In addition, in the case of polyurethanes, the foaming gas is formed by reaction of the starting materials for the wall material.

Not only pure materials but also mixtures may of course be used as the wall material. For example, a water-soluble polyurethane produced from diisocyanates and diols and foamed may be used as the wall material. If other substances (for example dyes, perfumes, enzymes, optical brighteners, silver protectors, surfactants, builders, bleaching agents, bleach activators, etc.) are added to the reaction mixture, they are incorporated in the walls and released when the tablets dissolve under in-use conditions.

Preferred detergent tablets according to the invention are characterized in that the solid partitions contain one or more detergent ingredients, preferably from the groups of surfactants, builders, cobuilders, polymers, bleaching agents, bleach activators, enzymes, foam inhibitors, optical brighteners, dyes and perfumes and/or disintegration aids.

In preferred embodiments of the present invention, the detergent tablets consist entirely (single-phase tablets) or partly (at least one phase of multiphase tablets) of water-soluble polymers which are present in admixture with detergent ingredients and optionally auxiliaries and/or fillers. According to the invention, polymer foams such as these may be used as a detergent or detergent component.

Accordingly, the present invention also relates to detergent tablets (solid foams) which are characterized by a content of a) 40 to 90% by weight of one or more water-soluble polymers,
b) 10 to 60% by weight of one or more substances from the group of builders, acidifying agents, chelating agents, scale-inhibiting polymers or nonionic surfactants,
c) 0 to 50% by weight of one or more auxiliaries and/or fillers.

The cell walls of the solid foams or tablet phases according to the invention consist of substances or substance mixtures which are solid at 25° C./1013.25 mbar. With inexpensive industrial manufacture in mind, preferred materials for the cell walls are solids which can be converted by dissolution, suspension, emulsification, melting, etc. into a liquid or high-viscosity paste which is then foamed by addition of filling gas (see above), the foam formed preferably being cured by cooling, solvent evaporation, delayed solvent binding, crystallization, chemical reaction (particularly polymerization, polycondensation or polyaddition), changes in the Theological properties or radiation curing.

According to the invention, therefore, suitable materials for the cell walls are water-soluble polymers which either are foamed in the form of concentrated solutions or suspensions or are only formed from their monomers during the foaming process. In addition, in the case of polyurethanes, the foaming gas is formed by reaction of the starting materials for the wall material. Molten mixtures of the water-soluble polymers and the other ingredients of the foams according to the invention may of course also be foamed.

The preferred detergent tablets according to the invention in the form of solid foams preferably contain water-soluble polymer(s) as ingredient a). Water-soluble polymers in the context of the present invention are polymers of which more than 2.5% by weight dissolves in water at room temperature. A particularly preferred embodiment is characterized by the use of certain water-soluble polymers. In preferred foams according to the invention, the water-soluble polymer(s) is/are selected from:

i) polyacrylic acids and salts thereof,
ii) polymethacrylic acids and salts thereof,
iii) polyvinyl pyrrolidone,
iv) vinyl pyrrolidone/vinyl ester copolymers,
v) cellulose ethers,
vi) polyvinyl acetates, polyvinyl alcohols and copolymers thereof,
vii) graft copolymers of polyethylene glycols and vinyl acetate,
viii) alkyl acrylamide/acrylic acid copolymers and salts thereof,
ix) alkyl acrylamide/methacrylic acid copolymers and salts thereof,
x) alkyl acrylamide/methyl methacrylic acid copolymers and salts thereof,
xi) alkyl acrylamide/acrylic acid/alkylaminoalkyl (meth) acrylic acid co-polymers and salts thereof,
xii) alkyl acrylamide/methacrylic acid/alkylaminoalkyl (meth)acrylic acid copolymers and salts thereof,
xiii) alkyl acrylamide/methyl methacrylic acid/alkylaminoalkyl (meth)acrylic acid copolymers and salts thereof,
xiv) alkyl acrylamide/alkyl methacrylate/alkylaminoethyl methacrylate/alkyl methacrylate copolymers and salts thereof,
xv) copolymers of
  xiii-i) unsaturated carboxylic acids and salts thereof,
  xiii-ii) cationically derivatized unsaturated carboxylic acids and salts thereof,
xvi) acrylamidoalkyl trialkylammonium chloride/acrylic acid copolymers and alkali metal and ammonium salts thereof,
xvii) acrylamidoalkyl trialkylammonium chloride/methacrylic acid copolymers and alkali metal and ammonium salts thereof,
xviii) methacroyl ethyl betaine/methacrylate copolymers,
xix) vinyl acetate/crotonic acid copolymers,
xx) acrylic acid/ethyl acrylate/N-tert.butyl acrylamide terpolymers,
xxi) graft polymers of vinyl esters, esters of acrylic acid or methacrylic acid individually or in admixture copolymerized with crotonic acid, acrylic acid or methacrylic acid with polyalkylene oxides and/or polyalkylene glycols,
xxii) grafted copolymers from the copolymerization of
  xx-i) at least one monomer of the nonionic type,
  xx-ii) at least one monomer of the ionic type,
xxiii) copolymers obtained by copolymerization of at least one monomer of each of the following three groups:
  xxi-i) esters of unsaturated alcohols and short-chain saturated carboxylic acids and/or esters of short-chain saturated alcohols and unsaturated carboxylic acids,
  xxi-ii) unsaturated carboxylic acids,
  xxi-iii) esters of long-chain carboxylic acids and unsaturated alcohols and/or esters of the carboxylic acids of group d6ii) with saturated or unsaturated, linear or branched $C_{8-18}$ alcohols.

The individual polymers mentioned above are described in more detail in the following.

Poly(meth)acrylic acids and their salts are described in detail hereinafter in connection with the co-builders.

Polyvinyl pyrrolidones iii) are marketed, for example, under the name of Luviskol® (BASF). Polyvinyl pyrrolidones are preferred polymers for the purposes of the invention. Polyvinyl pyrrolidones [poly(1-vinyl-2-pyrrolidinones)], PVPs for short, are polymers corresponding to general formula (I):

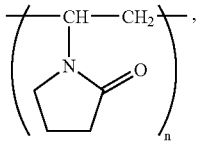

(I)

which are obtained by radical polymerization of 1-vinyl pyrrolidone by solution or suspension polymerization using radical formers (peroxides, azo compounds) as initiators. The ionic polymerization of the monomer only gives products of low molecular weight. Commercially available polyvinyl pyrrolidones have molecular weights of about 2,500 to 750,000 g/mole which are characterized by expressing the K values and—depending on their K value—have glass transition temperatures of 130 to 175° C. They are marketed as white hygroscopic powders or as aqueous solutions. Polyvinyl pyrrolidones are readily soluble in water and in a number of organic solvents (alcohols, ketones, glacial acetic acid, chlorinated hydrocarbons, phenols, etc.).

Vinyl pyrrolidone/vinyl acetate copolymers iv) are marketed, for example, under the registered name of Luvisko® (BASF). Luviskol® VA 64 and Luviskol® VA 73, both vinyl pyrrolidone/vinyl acetate copolymers, are particularly preferred polymers.

The vinyl ester polymers are polymers obtainable from vinyl esters containing a group corresponding to formula (II):

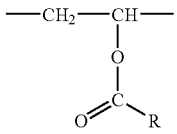

(II)

as the characteristic basic unit of the macromolecules. Of these, the vinyl acetate polymers ($R=CH_3$) with polyvinyl acetates, as by far the most important representatives, have the greatest commercial significance.

The polymerization of the vinyl esters is carried out by various radical polymerization processes (solution polymerization, suspension polymerization, emulsion polymerization, bulk polymerization). Copolymers of vinyl acetate with vinyl pyrrolidone contain monomer units corresponding to formulae (I) and (II).

Suitable cellulose ethers v) are, in particular, hydroxypropyl cellulose, hydroxyethyl cellulose and methyl hydroxypropyl cellulose which are marketed for example under the registered names of Culminal® and Benecel® (AQUALON). Cellulose ethers correspond to general formula (III):

(III)

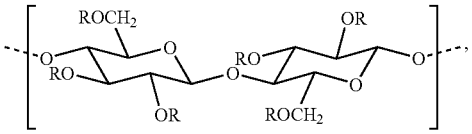

in which R represents H or an alkyl, alkenyl, alkinyl, aryl or alkylaryl group. In preferred products, at least one R in formula (III) stands for $—CH_2CH_2CH_2—OH$ or $—CH_2CH_2—OH$. On an industrial scale, cellulose ethers are produced by etherification of alkali metal cellulose (for example with ethylene oxide). Cellulose ethers are characterized by the average degree of substitution DS or the molar degree of substitution MS which indicates how many hydroxy groups of an anhydroglucose unit of the cellulose have reacted with the etherifying agent or how many moles of the etherifying agent on average have been added onto one anhydroglucose unit. Hydroxyethyl celluloses are soluble in water where they have a DS of about 0.6 or higher or an MS of about 1 or higher. Commercially available hydroxyethyl or hydroxypropyl celluloses have degrees of substitution of 0.85 to 1.35 (DS) or 1.5 to 3 (MS). Hydroxyethyl and hydroxypropyl celluloses are marketed as yellowish-white, odorless and tasteless powders with various degrees of polymerization. Hydroxyethyl and hydroxypropyl celluloses are soluble in cold and hot water and in certain (water-containing) organic solvents, but are insoluble in most (water-free) organic solvents. Their aqueous solutions are relatively non-sensitive to changes in pH or to the addition of an electrolyte.

Other particularly preferred water-soluble polymers are polyvinyl acetals, polyvinyl alcohols and copolymers thereof. Of these, homopolymers of vinyl alcohol, copolymers of vinyl alcohol with copolymerizable monomers or hydrolysis products of vinyl ester homopolymers or vinyl ester copolymers with copolymerizable monomers are preferred, so that foams according to the invention where the water-soluble polymer(s) is/are selected from homopolymers of vinyl alcohol, copolymers of vinyl alcohol with copolymerizable monomers or hydrolysis products of vinyl ester homopolymers or vinyl ester copolymers with copolymerizable monomers represent preferred embodiments of the present invention. Homo- or copolymers of vinyl alcohol cannot be obtained by polymerization of vinyl alcohol ($H_2C{=}CH—OH$) because its concentration in the tautomer equilibrium with acetaldehyde ($H_3C—CHO$) is too low. Accordingly, these polymers are prepared above all from polyvinyl esters, more particularly polyvinyl acetals, by polymer-analog reactions, such as hydrolysis, but on an industrial scale especially by alkali-catalyzed transesterification with alcohols (preferably methanol) in solution.

According to the invention, polyvinyl alcohols are particularly preferred water-soluble polymers. Polyvinyl alcohols, referred to in short as PVALs, are polymers with the following general structure:

$$[—CH_2—CH(OH)—]_n$$

which also contain small amounts of structural units of the following type:

$$[—CH_2—CH(OH)—CH(OH)—CH_2]$$

Commercially available PVALs, which are marketed as white-yellowish powders or granules with degrees of polymerization of ca. 500 to 2,500 (corresponding to molecular weights of ca. 4,000 to 100,000 g/mole), have degrees of hydrolysis of 98-99 or 87-89 mole-%, i.e. still have a residual content of acetyl groups. The polyvinyl alcohols are characterized by their manufacturers by the degree of polymerization of the starting polymer, the degree of hydrolysis, the saponification number or the solution viscosity.

Depending on their degree of hydrolysis, polyvinyl alcohols are soluble in water and in a few highly polar organic solvents (formamide, dimethyl formamide, dimethyl sulfoxide); they are not affected by (chlorinated) hydrocarbons, esters, fats and oils. Polyvinyl alcohols are classified as toxicologically safe and are at least partly biodegradable. Their solubility in water can be reduced by aftertreatment with aldehydes (acetalization), by complexing with Ni or Cu salts or by treatment with dichromates, boric acid or borax. The coatings of polyvinyl alcohol are largely impenetrable to gases such as oxygen, nitrogen, helium, hydrogen, carbon dioxide but allow water vapor through.

According to the invention, preferred foams are characterized in that the water-soluble polymer is a polyvinyl alcohol with a degree of hydrolysis of 70 to 100 mol-%, preferably 80 to 90 mol-%, more preferably 81 to 89 mol-% and most preferably 82 to 88 mol-%.

Polyvinyl alcohols with a certain molecular weight range are preferably used, preferred foams according to the invention being characterized in that the water-soluble polymer is polyvinyl alcohol with a molecular weight in the range from 10,000 to 100,000 $gmol^{-1}$, preferably in the range from 11,000 to 90,000 $gmol^{-1}$, more preferably in the range from 12,000 to 80,000 $gmol^{-1}$ and most preferably in the range from 13,000 to 70,000 $gmol^{-1}$.

The degree of polymerization of such preferred polyvinyl alcohols is between about 200 and about 2100, preferably between about 220 and about 1890, more preferably between about 240 and about 1680 and most preferably between about 260 and about 1500.

The above-described polyvinyl alcohols are commercially widely available, for example under the registered name of Erkol® (ERKOL). According to the invention, particularly suitable polyvinyl alcohols are, for example, Erkol® 3-83, Erkol® 4-88, Erkol® 5-88 and Erkol® 8-88.

Other suitable water-soluble polymers a) are graft polymers of vinyl esters, esters of acrylic acid or methacrylic acid individually or in admixture copolymerized with crotonic acid, acrylic acid or methacrylic acid with polyalkylene oxides and/or polyalkylene glycols. Corresponding grafted polymers of vinyl esters, esters of acrylic acid or methacrylic acid individually or in admixture with other copolymerizable compounds on polyalkylene glycols are obtained by high-temperature polymerization in homogeneous phase by stirring the polyalkylene glycols into the monomers, i.e. vinyl esters, esters of acrylic or methacrylic acid, in the presence of radical formers.

Suitable vinyl esters are, for example, vinyl acetate, vinyl propionate, vinyl butyrate, vinyl benzoate while suitable esters of acrylic or methacrylic acid are those obtainable with low molecular weight aliphatic alcohols, i.e. in particular ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-i-butanol; 3-methyl-2-butanol, 2-methyl-2-butanol, 2-methyl-1-butanol, 1-hexanol.

Suitable polyalkylene glycols are, in particular, polyethylene glycols and polypropylene glycols. Polyethylene glycols are polymers of ethylene glycol which correspond to general formula (IV):

$$H—(O—CH_2—CH_2)_n—OH \quad (IV)$$

where n may assume values of 1 (ethylene glycol) to several thousand. Various nomenclatures are used for polyethylene glycols which can lead to confusion. It is common practice to indicate the mean relative molecular weight after the initials "PEG", so that "PEG 200" characterizes a polyethylene glycol having a relative molecular weight of about 190 to about 210. Cosmetic ingredients are covered by another nomenclature in which the initials PEG are followed by a hyphen and the hyphen is in turn directly followed by a number which corresponds to the index n in general formula V above. Under this nomenclature (so-called INCI nomenclature, CTFA International Cosmetic Ingr di nt Dictionary and Handbook, 5th Edition, The Cosmetic, Toiletry and Fragrance Association, Washington, 1997), PEG-4, PEG-6, PEG-8, PEG-9, PEG-10, PEG-12, PEG-14 and PEG-16, for example, may be used. Polyethylene glycols are commercially obtainable, for example, under the names of Carbowax® PEG 200 (Union Carbide), Emkapol® 200 (ICI Americas), Lipoxo® 200 MED (HÜLS America), Polyglycol® E-200 (Dow Chemical), Alkapol® PEG 300 (Rhone-Poulenc), Lutrol® E300 (BASF) and the corresponding commercial names with higher numbers.

Polypropylene glycols (PPGs) are polymers of propylene glycol which correspond to general formula (V):

$$H—(O—\underset{\underset{CH_3}{|}}{CH}—CH_2)_n—OH \quad (V)$$

where n may assume a value of 1 (propylene glycol) to several thousand. Di-, tri- and tetrapropylene glycol, i.e. representatives where n=2, 3 and 4 in formula VIII, are of particular commercial significance.

More particularly, the vinyl acetate copolymers grafted onto poly-ethylene glycols and the polymers of vinyl acetate and crotonic acid grafted onto polyethylene glycols may be used.

Grafted and crosslinked copolymers from the copolymerization of i) at least one monomer of the nonionic type,
ii) at least one monomer of the ionic type,
iii) polyethylene glycol and
iv) a crosslinking agent.

The polyethylene glycol used has a molecular weight of 200 to several million and preferably in the range from 300 to 30,000.

The monomers may be of various types, among which the following are preferred: vinyl acetate, vinyl stearate, vinyl laurate, vinyl propionate, allyl stearate, allyl laurate, diethyl maleate, allyl acetate, methyl methacrylate, cetyl vinyl ether, stearyl vinyl ether and 1-hexene. The monomers of the second group may also be of various types, among which crotonic acid, allyloxyacetic acid, vinyl acetic acid, maleic acid, acrylic acid and methacrylic acid are present with particular advantage in the graft polymers.

Preferred crosslinking agents are ethylene glycol dimethacrylate, diallyl phthalate, ortho-, meta- and para-divinyl benzene, tetraallyloxy ethane and polyallyl saccharoses containing 2 to 5 allyl groups per molecule of saccharin.

The grafted and crosslinked copolymers described above are preferably formed from:

i) 5 to 85% by weight of at least one monomer of the nonionic type,
ii) 3 to 80% by weight of at least one monomer of the ionic type,
iii) 2 to 50% by weight and preferably 5 to 30% by weight of polyethylene glycol and
iv) 0.1 to 8% by weight of a crosslinking agent, the percentage of the crosslinking agent being determined by the ratio of the total weights of i), ii) and iii).

Other suitable water-soluble polymers are copolymers of alkyl acrylamide with acrylic acid, alkyl acrylamide with methacrylic acid, alkyl acrylamide with methylmethacrylic acid and alkyl acrylamide/acrylic acid/alkyl aminoalkyl(meth)acrylic acid copolymers, alkyl acrylamide/methacrylic acid/alkyl aminoalkyl (meth)acrylic acid copolymers, alkyl acrylamide/methyl methacrylic acid/alkyl aminoalky(meth)acrylic acid copolymers, alkyl acrylamide/alkyl methacrylate/alkyl aminoethyl methacrylate/alkyl methacrylate copolymers and copolymers of unsaturated carboxylic acids, cationically derivatized unsaturated carboxylic acids and optionally other ionic or nonionic monomers.

Other polymers suitable for the purposes of the invention are water-soluble "amphopolymers". "Amphopolymers" is the generic term for amphoteric polymers, i.e. polymers which contain both free amino groups and free —COOH or —$SO_3H$ groups in the molecule and which are capable of forming inner salts, zwitterionic polymers which contain quaternary ammonium groups and —$COO^-$ or —$SO_3^-$ groups in the molecule, and for polymers which contain —COOH or —$SO_3H$ groups and quaternary ammonium groups. One example of an amphopolymer suitable for use in accordance with the invention is the acrylic resin obtainable under the name of Amphomer®, which is a copolymer of tert.butyl aminoethyl methacrylate, N-(1,1,3,3-tetramethylbutyl)acrylamide and two or more monomers from the group consisting of acrylic acid, methacrylic acid and simple esters thereof. Other preferred amphopolymers consist of unsaturated carboxylic acids (for example acrylic and methacrylic acid), cationically derivatized unsaturated carboxylic acids (for example acrylamidopropyl trimethyl ammonium chloride) and optionally other ionic or nonionic monomers. According to the invention, terpolymers of acrylic acid, methyl acrylate and methacrylamidopropyl trimonium chloride, which are commercially available under the name of Merquat® 2001 N, are particularly preferred amphopolymers. Other suitable amphoteric polymers are, for example, the octyl acrylamide/methyl methacrylate/tert.butylaminoethyl methacrylate/2-hydroxypropyl methacrylate copolymers obtainable under the names of Amphomer® and Amphomer® LV-71 (DELFT NATIONAL).

Suitable zwitterionic polymers are, for example, acrylamidopropyl trimethylammonium chloride/acrylic acid or methacrylic acid copolymers and alkali metal and ammonium salts thereof. Other suitable zwitterionic polymers are methacroyl ethyl betaine/methacrylate copolymers which are commercially obtainable under the name of Amersette® (AMERCHOL).

Anionic polymers suitable for the purposes of the present invention include:

Vinyl acetate/crotonic acid copolymers which are marketed, for example, under the names of Resyn® (NATIONAL STARCH), Luviset® (BASF) and Gafset® (GAF).

Besides monomer units corresponding to formula (IV) above, these polymers also contain monomer units corresponding to general formula (VI):

$$[—CH(CH_3)—CH(COOH)—]_n \quad (VI)$$

Vinyl pyrrolidone/vinyl acrylate copolymers obtainable, for example, under the registered name of Luviflex® (BASF). A preferred polymer is the vinyl pyrrolidone/acrylate terpolymer obtainable under the name of Luviflex® VBM-35 (BASF).

Acrylic acid/ethylacrylate/N-tert.butyl acrylamide terpolymers which are marketed, for example, under the name of Ultrahold® strong (BASF).

Graft polymers of vinyl esters, esters of acrylic acid or methacrylic acid individually or in admixture copolymerized with crotonic acid, acrylic acid or methacrylic acid with polyalkylene oxides and/or polyalkylene glycols.

Corresponding grafted polymers of vinyl esters, esters of acrylic acid or methacrylic acid individually or in admixture with other copolymerizable compounds on polyalkylene glycols are obtained by high-temperature polymerization in homogeneous phase by stirring the polyalkylene glycols into the monomers, i.e. vinyl esters, esters of acrylic or methacrylic acid, in the presence of radical formers.

Suitable vinyl esters are, for example, vinyl acetate, vinyl propionate, vinyl butyrate, vinyl benzoate while suitable esters of acrylic or methacrylic acid are those obtainable with low molecular weight aliphatic alcohols, i.e. in particular ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-i-butanol; 3-methyl-2-butanol, 2-methyl-2-butanol, 2-methyl-i-butanol, 1-hexanol.

The grafted and crosslinked copolymers described above are preferably formed from:

i) 5 to 85% by weight of at least one monomer of the nonionic type, ii) 3 to 80% by weight of at least one monomer of the ionic type, iii) 2 to 50% by weight and preferably 5 to 30% by weight of polyethylene glycol and iv) 0.1 to 8% by weight of a crosslinking agent, the percentage of the crosslinking agent being determined by the ratio of the total weights of i), ii) and iii).

According to the invention, copolymers obtained by copolymerization of at least one monomer from each of the following three groups:

i) esters of unsaturated alcohols and short-chain saturated carboxylic acids and/or esters of short-chain saturated alcohols and unsaturated carboxylic acids, ii) unsaturated carboxylic acids, iii) esters of long-chain carboxylic acids and unsaturated alcohols and/or esters of the carboxylic acids of group ii) with saturated or unsaturated, linear or branched $C_{8-18}$ alcohol, are also suitable for use as ingredient a).

Short-chain carboxylic acids or alcohols in the context of the present invention are understood to be those containing 1 to 8 carbon atoms, the carbon chains of these compounds optionally being interrupted by two-bond hetero groups, such as —O—, —NH—, —S—.

Another particularly preferred class of polymers which may be present as ingredient a) in the solid foam according to the invention are polyurethanes. Polyurethanes are water-soluble in the context of the invention if they have a solubility in water at room temperature of more than 2.5% by weight.

The polyurethanes consist of at least two different monomer types, namely:

a compound (A) containing at least two active hydrogen atoms per molecule and a di- or polyisocyanate (B).

The compounds (A) may be, for example, diols, triols, diamines, triamines, polyetherols and polyesterols. The compounds containing more than two active hydrogen atoms are normally used in only very small quantities in combination with a large excess of compounds containing two active hydrogen atoms.

Examples of compounds (A) are ethylene glycol, 1,2- and 1,3-propylene glycol, butylene glycols, di-, tri-, tetra- and poly-ethylene and -propylene glycols, copolymers of lower alkylene oxides, such as ethylene oxide, propylene oxide and butylene oxide, ethylenediamine, propylenediamine, 1,4-diaminobutane, hexamethylenediamine and α,ω-diamines based on long-chain alkanes or polyalkylene oxides.

Polyurethanes in which the compounds (A) are diols, triols and polyetherols can be preferred for the purposes of the invention. Polyethylene glycols and polypropylene glycols in particular with molecular weights of 200 to 3,000 and more particularly in the range from 1,600 to 2,500 have proved to be particularly suitable in individual cases. Polyesterols are normally obtained by modification of compound (A) with dicarboxylic acids, such as phthalic acid, isophthalic acid and adipic acid.

Hexamethylene diisocyanate, 2,4- and 2,6-toluene diisocyanate, 4,4'-methylene di(phenylisocyanate) and in particular isophorone diisocyanate are mainly used as the compounds (B). These compounds may be represented by general formula (VII):

$$O=C=N—R^1—N=C=O \quad (VII)$$

in which $R^1$ is a connecting group of carbon atoms, for example a methylene, ethylene, propylene, butylene, pentylene, hexylene etc. group. In the above-mentioned and, industrially, the most commonly used hexamethylene diisocyanate (HMDI), $R^4=(CH_2)_6$; in 2,4- or 2,6-toluene diisocyanate (TDI), $R^4=C_6H_3—CH_3$); in 4,4'-methylene di(phenylisocyanate) (MDI), $R^4=C_6H_4—CH_2—C_6H_4$) and, in isophorone diisocyanate, $R^4$ stands for the isophorone residue (3,5,5-trimethyl-2-cyclohexenone).

In addition, the polyurethanes used in accordance with the invention may also contain such structural units as, for example, diamines as chain extenders and hydroxycarboxylic acids. Dialkylolcarboxylic acids such as, for example, dimethylolpropionic acid are particularly suitable hydroxycarboxylic acids. So far as the other structural units are concerned, it is basically immaterial whether they are nonionic, anionic or cationic structural units.

Further information on the structure and production of polyurethanes can be found in the articles in the relevant synoptic works, such as Römpps Chemie-Lexikon and Ullmanns Enzyklopädie der technischen Chemie.

Polyurethanes which have proved to be particularly suitable for the purposes of the invention in many cases may be characterized as follows:

only aliphatic groups in the molecule no free isocyanate groups in the molecule polyether and polyester polyurethanes anionic groups in the molecule.

Particularly preferred polyurethanes as ingredient a) of the solid foams according to the invention at least partly contain polyalkylene glycol units in the molecule. Particularly preferred foams according to the invention are characterized in that the water-soluble polymer(s) is/are selected from polyurethanes of diisocyanates (VII) and diols (VIII):

$$O{=}C{=}N{-}R^1{-}N{=}C{=}O \quad \text{(VII)}$$

$$H{-}O{-}R^2{-}O{-}H \quad \text{(VII)},$$

the diols being at least partly selected from polyethylene glycols (IV) and/or polypropylene glycols (V):

$$H{-}(O{-}CH_2{-}CH_2)_n{-}OH \quad \text{(IV)}$$

$$H{-}(O{-}\underset{\underset{CH_3}{|}}{CH}{-}CH_2)_n{-}OH \quad \text{(V)}$$

and $R^1$ and $R^2$ independently of one another representing a substituted or unsubstituted, linear or branched alkyl, aryl or alkylaryl group containing 1 to 24 carbon atoms and n is a number of 5 to 2,000.

In addition, the reaction mixtures may contain other polyisocyanates.

The reaction mixtures and hence the polyurethanes may also contain other diols, triols, diamines, triamines, polyetherols and polyesterols. The compounds containing more than two active hydrogen atoms are normally used in only small quantities in combination with a large excess of compounds containing two active hydrogen atoms.

If other diols, etc. are added, they have to be used in certain quantity ratios to the polyethylene and/or polypropylene glycol units present in the polyurethane. Preferred polyurethanes are characterized in that at least 10% by weight, preferably at least 25% by weight, more preferably at least 50% by weight and most preferably at least 75% by weight of the diols reacted into the polyurethane are selected from polyethylene glycols (IV) and/or polypropylene glycols (V).

Both in the case of compounds corresponding to formula (IV) and in the case of compounds corresponding to formula (V), preferred monomer units are those representatives where n is a number of 6 to 1,500, preferably 7 to 1,200, more preferably 8 to 1,000, most preferably 9 to 500 and, in one particular embodiment, 10 to 200. Polyethylene and polypropylene glycols corresponding to formula (IV) and/or (V) in which n is a number of 15 to 150, preferably 20 to 100, more preferably 25 to 75 and most preferably 30 to 60 can be preferred for certain applications.

Examples of other compounds optionally present in the reaction mixtures for the production of the polyurethanes are ethylene glycol, 1,2- and 1,3-propylene glycol, butylene glycols, ethylenediamine, propylenediamine, 1,4-diaminobutane, hexamethylenediamine and α,ω-diamines based on long-chain alkanes or polyalkylene oxides. Preferred solid foams according to the invention are characterized in that the polyurethanes contain additional diamines, preferably hexamethylenediamine, and/or hydroxycarboxylic acids, preferably dimethylolpropionic acid.

To sum up these observations, particularly preferred foams according to the invention are characterized in that the water-soluble polymer is a polyurethane of diisocyanates (I) and diols (II):

$$O{=}C{=}N{-}R^1{-}N{=}C{=}O \quad \text{(VII)}$$

$$H{-}O{-}R^2{-}O{-}H \quad \text{(VIII)}$$

where $R^1$ is a methylene, ethylene, propylene, butylene, pentylene group or $-(CH_2)_6-$ or 2,4- or 2,6-$C_6H_3-CH_3$ or $C_6H_4-CH_2-C_6H_4$ or an isophorone residue (3,5,5-trimethyl-2-cyclohexenone) and $R^2$ is selected from $-CH_2-CH_2-(O-CH_2-CH_2)_n-$ or $-CH_2-CH_2-(O-CH(CH_3)-CH_2)_n-$ with n=4 to 1999.

Depending on which reactants are reacted together to form the polyurethanes, polymers with different structural units are obtained. Preferred foams according to the invention are characterized in that the water-soluble polymer is a polyurethane which contains structural elements corresponding to formula (IX):

$$-[O-C(O)-NH-R^1-NH-C(O)-O-R^2]_k- \quad \text{(IX)}$$

where $R^1$ is $-(CH_2)_6-$ or 2,4- or 2,6-$C_6H_3-CH_3$ or $C_6H_4-CH_2-C_6H_4$ and $R^2$ is selected from $-CH_2-CH_2-(O-CH_2-CH_2)_n-$ or $-CH(CH_3)-CH_2-(O-CH(CH_3)-CH_2)_n-$ with n=5 to 199 and k=1 to 2,000.

The diisocyanates described as preferred can be reacted with all the diols described as preferred to form polyurethanes so that preferred foams according to the invention contain polyurethanes with one or more structural units (IXa) to (IXh):

$$[O-C(O)-NH-(CH_2)_6-NH-C(O)-O-CH_2-CH_2-(O-CH_2-CH_2)_n]_k- \quad \text{(IX a)},$$

$$-[O-C(O)-NH-(2,4-C_6H_3-CH_3)-NH-C(O)-O-CH_2-CH_2-(O-CH_2-CH_2)_n]_k- \quad \text{(IX b)},$$

$$-[O-C(O)-NH-(2,6-C_6H_3-CH_3)-NH-C(O)-O-CH_2-CH_2-(O-CH_2-CH_2)_n]_k- \quad \text{(IX c)},$$

$$-[O-C(O)-NH-(C_6H_4-CH_2-C_6H_4)-NH-C(O)-O-CH_2-CH_2-(O-CH_2-CH_2)_n]_k- \quad \text{(IX d)},$$

$$-[O-C(O)-NH-(CH_2)_6-NH-C(O)-O-CH(CH_3)-CH_2-(O-CH(CH_3)-CH_2-CH_2)_n]_k- \quad \text{(IX e)},$$

$$-[O-C(O)-NH-(2,4-C_6H_3-CH_3)-NH-C(O)-O-CH(CH_3)-CH_2-(O-CH(CH_3)-CH_2)_n]_k- \quad \text{(IX f)},$$

$$-[O-C(O)-NH-(2,6-C_6H_3-CH_3)-NH-C(O)-O-CH(CH_3)-CH_2-(O-CH(CH_3)-CH_2)_n]_k- \quad \text{(IX g)},$$

$$-[O-C(O)-NH-(C_6H_4-CH_2-C_6H_4)-NH-C(O)-O-CH(CH_3)-CH_2-(O-CH(CH_3)-CH_2)_n]_k- \quad \text{(IX h)},$$

where n is a number of 5 to 199 and k is a number of 1 to 2,000.

As mentioned above, the reaction mixtures may contain other compounds from the group of polyisocyanates (particularly triisocyanates and tetraisocyanates) and from the group of polyols and/or di- or polyamines besides diisocyanates (VII) and diols (VIII). Triols, tetrols, pentols and hexols and di- and triamines in particular may be present in the reaction mixtures. The presence of compounds containing more than two "active" H atoms (all the classes of compounds mentioned above except the diamines) leads to partial crosslinking of the polyurethane reaction products and can result in advantageous properties such as, for example, control of dissolving behavior, abrasion stability or flexibility of the foams according to the invention, process-related advantages in production, etc. The content of such compounds containing more than two "active" H atoms in the reaction mixture is less than 20% by weight of the total of the reactants used for the diisocyanates, preferably less than 15% by weight and more particularly less than 5% by weight.

In preferred embodiments of the present invention, the polyurethanes in the foams according to the invention have molecular weights of 5,000 to 150,000 $gmol^{-1}$, preferably in the range from 10,000 to 100,000 $gmol^{-1}$ and more particularly in the range from 20,000 to 50,000 $gmol^{-1}$.

The quantities in which the water-soluble polymer(s) is/are present in the solid foams according to the invention are from 40 to 90% by weight, based on the solid foam. Preferred foams are characterized in that they contain the water-soluble polymer(s) in quantities of 45 to 87.5% by weight, preferably in quantities of 50 to 85% by weight, more preferably in quantities of 55 to 82.5% by weight and most preferably in quantities of 60 to 80% by weight.

The solid foams according to the invention contain 10 to 60% by weight of one or more substances from the group of builders, acidifying agents, chelating agents, scale-inhibiting polymers or nonionic surfactants as a second ingredient. Irrespective of the nature of ingredient b), preferred foams are characterized in that they contain ingredient b) in quantities of 12.5 to 55% by weight, preferably 15 to 50% by weight, more preferably 17.5 to 45% by weight and most preferably 20 to 40% by weight. The classes of compounds mentioned and preferred representatives thereof are described in the following.

The most important ingredients of laundry detergents or dishwasher detergents are builders. Any of the builders typically used in detergents/cleaners, i.e. in particular zeolites, silicates, carbonates, organic cobuilders and phosphates, may be present as ingredient b) in the foams according to the invention.

Suitable crystalline layered sodium silicates correspond to the general formula $NaMSi_xO_{2x+1}.yH_2O$, where M is sodium or hydrogen, x is a number of 1.9 to 4 and y is a number of 0 to 20, preferred values for x being 2, 3 or 4. Preferred crystalline layered silicates corresponding to the above formula are those in which M is sodium and x assumes the value 2 or 3. Both β- and δ-sodium disilicates $Na_2Si_2O_5.yH_2O$ are particularly preferred.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these also dissolve with delay in relation to conventional waterglasses. Compacted amorphous silicates, compounded amorphous silicates and overdried X-ray-amorphous silicates are particularly preferred.

The finely crystalline, synthetic zeolite containing bound water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is preferred to use, for example, a commercially obtainable co-crystallizate of zeolite X and zeolite A (ca. 80% by weight zeolite X) which is marketed by CONDEA Augusta S.p.A. under the name of VEGOBOND AX® and which may be described by the following formula:

$$nNa_2O.(1-n)K_2O.Al_2O_3.(2-2.5)SiO_2.(3.5-5.5)H_2O.$$

Suitable zeolites have a mean particle size of less than 10 μm (volume distribution, as measured by the Coulter Counter Method) and contain preferably 18 to 22% by weight and more preferably 20 to 22% by weight of bound water.

The generally known phosphates may of course also be used as builders providing their use should not be avoided on ecological grounds. Among the large number of commercially available phosphates, alkali metal phosphates have the greatest importance in the detergent industry, pentasodium triphosphate and pentapotassium triphosphate (sodium and potassium tripolyphosphate) being particularly preferred. "Alkali metal phosphates" is the collective term for the alkali metal (more particularly sodium and potassium) salts of the various phosphoric acids, including metaphosphoric acids $(HPO_3)_n$ and orthophosphoric acid ($H_3PO_4$) and representatives of higher molecular weight. The phosphates combine several advantages: they act as alkalinity sources, prevent lime deposits on machine parts and lime incrustations in fabrics and, in addition, contribute towards the cleaning effect.

Sodium dihydrogen phosphate ($NaH_2PO_4$) exists as the dihydrate (density 1.91 $gcm^{-3}$, melting point 60°) and as the monohydrate (density 2.04 $gcm^{-3}$). Both salts are white readily water-soluble powders which, on heating, lose the water of crystallization and, at 200° C., are converted into the weakly acidic diphosphate (disodium hydrogen diphosphate, $Na_2H_2P_2O_7$) and, at higher temperatures, into sodium trimetaphosphate ($Na_3P_3O_9$) and Maddrell's salt (see below). $NaH_2PO_4$ shows an acidic reaction. It is formed by adjusting phosphoric acid with sodium hydroxide to a pH value of 4.5 and spraying the resulting "mash". Potassium dihydrogen phosphate (primary or monobasic potassium phosphate, potassium biphosphate, KDP), $KH_2PO_4$, is a white salt with a density of 2.33 $gcm^{-3}$, has a melting point of 253° [decomposition with formation of potassium polyphosphate $(KPO_3)_x$] and is readily soluble in water.

Disodium hydrogen phosphate (secondary sodium phosphate), $Na_2HPO_4$, is a colorless, readily water-soluble crystalline salt. It exists in water-free form and with 2 moles (density 2.066 $gcm^{-3}$, water loss at 95°), 7 moles (density 1.68 $gcm^{-3}$, melting point 48° with loss of 5 $H_2O$) and 12 moles of water (density 1.52 $gcm^{-3}$, melting point 35° with loss of 5 $H_2O$), becomes water-free at 100° and, on fairly intensive heating, is converted into the diphosphate $Na_4P_2O_7$. Disodium hydrogen phosphate is prepared by neutralization of phosphoric acid with soda solution using phenol-phthalein as indicator. Dipotassium hydrogen phosphate (secondary or dibasic potassium phosphate), $K_2HPO_4$, is an amorphous white salt which is readily soluble in water.

Trisodium phosphate, tertiary sodium phosphate, $Na_3PO_4$, consists of colorless crystals which have a density of 1.62 $gcm^{-3}$ and a melting point of 73-76° C. (decomposition) as the dodecahydrate, a melting point of 100° C. as the decahydrate (corresponding to 19-20% $P_2O_5$) and a density of 2.536 $gcm^{-3}$ in water-free form (corresponding to 39-40% $P_2O_5$). Trisodium phosphate is readily soluble in water through an alkaline reaction and is prepared by concentrating a solution of exactly 1 mole of disodium phosphate and 1 mole of NaOH by evaporation. Tripotassium phosphate (tertiary or tribasic potassium phosphate), $K_3PO_4$, is a white deliquescent granular powder with a density of 2.56 $gcm^{-3}$, has a melting point of 1340° and is readily soluble in water through an alkaline reaction. It is formed, for example, when Thomas slag is heated with coal and potassium sulfate. Despite their higher price, the more readily soluble and therefore highly effective potassium phosphates are often preferred to corresponding sodium compounds in the detergent industry.

Tetrasodium diphosphate (sodium pyrophosphate), $Na_4P_2O_7$, exists in water-free form (density 2.534 $gcm^{-3}$, melting point 988°, a figure of 880° has also been mentioned) and as the decahydrate (density 1.815-1.836 $gcm^{-3}$, melting point 94° with loss of water). Both substances are colorless crystals which dissolve in water through an alkaline reaction. $Na4P_2O_7$ is formed when disodium phosphate is heated to >200° or by reacting phosphoric acid with soda in a stoichiometric ratio and spray-drying the solution. The decahydrate complexes heavy metal salts and hardness salts and, hence, reduces the hardness of water. Potassium diphosphate (potassium pyrophosphate), $K_4P_2O_7$, exists in the form of the trihydrate and is a colorless hygroscopic powder with a density of 2.33 $gcm^{-3}$ which is soluble in water, the pH value of a 1% solution at 25° being 10.4.

Relatively high molecular weight sodium and potassium phosphates are formed by condensation of $NaH_2PO_4$ or $KH_2PO_4$. They may be divided into cyclic types, namely the sodium and potassium metaphosphates, and chain types, the sodium and potassium polyphosphates. The chain types in particular are known by various different names: fused or calcined phosphates, Graham's salt, Kurrol's salt and Maddrell's salt. All higher sodium and potassium phosphates are known collectively as condensed phosphates.

The industrially important pentasodium triphosphate, $Na_5P_3O_{10}$ (sodium tripolyphosphate), is a non-hygroscopic white water-soluble salt which crystallizes without water or with 6 $H_2O$ and which has the general formula NaO—[P(O)(ONa)—O]$_n$—Na where n=3. Around 17 g of the salt free from water of crystallization dissolve in 100 g of water at room temperature, around 20 g at 60° and around 32 g at 100°. After heating of the solution for 2 hours to 100°, around 8% orthophosphate and 15% diphosphate are formed by hydrolysis. In the preparation of pentasodium triphosphate, phosphoric acid is reacted with soda solution or sodium hydroxide in a stoichiometric ratio and the solution is spray-dried. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is marketed for example in the form of a 50% by weight solution (>23% $P_2O_5$, 25% $K_2O$). The potassium polyphosphates are widely used in the detergent industry. Sodium potassium tripolyphosphates, which may also be used in accordance with the invention, also exist. They are formed for example when sodium trimetaphosphate is hydrolyzed with KOH:

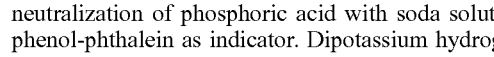

$$(NaPO_3)_3+2\ KOH \rightarrow Na_3K_2P_3O_{10}+H_2O$$

According to the invention, they may be used in exactly the same way as sodium tripolyphosphate, potassium tripolyphosphate or mixtures thereof. Mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate may also be used in accordance with the invention.

Other suitable builders are carbonates, hydrogen carbonates and the salts of oligocarboxylic acids, for example gluconates, succinates and particularly citrates. According to the invention, foams which contain one or more builders from the group of sodium carbonate, sodium hydrogen carbonate and trisodium citrate are particularly preferred.

According to the invention acidifying agents are also suitable for use as ingredient b). Suitable acidifying agents are, for example, boric acid and alkali metal hydrogen sulfates, alkali metal dihydrogen phosphates and other inorganic salts. However, organic acidifying agents are preferably used, citric acid being a particularly preferred acidifying agent. However, other solid mono-, oligo- and polycarboxylic acids in particular may also be used. Within this group, tartaric acid, succinic acid, malonic acid, adipic acid, maleic acid, fumaric acid, oxalic acid and polyacrylic acid are preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially obtainable and may also be used with advantage as an acidifying agent for the purposes of the present invention.

Another possible group of ingredients b) are chelating agents. Chelating agents are substances which form cyclic compounds with metal ions, an individual ligand occupying more than one co-ordination site at a central atom, i.e. is at least "bidentate", In this case, therefore, normally stretched compounds are closed to form rings by complexing via an ion. The number of bound ligands depends upon the co-ordination number of the central ion.

Typical and—according to the invention—preferred chelating agents are, for example, polyoxycarboxylic acids, polyamines, ethylenediamine tetraacetic acid (EDTA) and nitrilotriacetic acid (NTA). Complexing polymers, i.e. polymers which, either in the main chain itself or laterally thereof, carry functional groups which are capable of acting as ligands and which react with suitable metal atoms, generally to form chelate complexes, may also be used in accordance with the invention. The polymer-bound ligands of the metal complexes formed may emanate from only one macromolecule or belong to various polymer chains. The latter leads to crosslinking of the material providing the complexing polymers were not already crosslinked through covalent bonds.

Complexing groups (ligands) of typical complexing polymers are iminodiacetic acid, hydroxyquinoline, thiourea, guanidine, dithiocarbamate, hydroxamic acid, amidoxime, aminophosphonic acid, (cycl.) polyamino, mercapto, 1,3-dicarbonyl and crown ether residues with, in some cases, very specific activities towards ions of various metals. Base polymers of many—even commercially significant—complexing polymers are polystyrene, polyacrylates, polyacrylonitriles, polyvinyl alcohols, polyvinyl pyridines and polyethylene imines. Natural polymers, such as cellulose, starch or chitin, are complexing polymers. In addition, these complexing polymers can be provided with further ligand functionalities by polymer-analog conversions.

According to the invention, particularly preferred foams contain one or more chelating agents from the groups of (i) polycarboxylic acids where the sum of carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids,
(vi) cyclodextrins, as ingredient b).

Any known complexing agents may be used for the purposes of the present invention. They may belong to various chemical groups. The following are preferably used either individually or in the form of mixtures with one another:

a) polycarboxylic acids where the sum of carboxyl and optionally hydroxyl groups is at least 5, such as gluconic acid,
b) nitrogen-containing mono- or polycarboxylic acids, such as ethylenediamine tetraacetic acid (EDTA), N-hydroxyethyl ethylenediamine triacetic acid, diethylenetriamine pentaacetic acid, hydroxyethyl iminodiacetic acid, nitrilodiacetic acid-3-propionic acid, isoserine diacetic acid, N,N-di-(β-hydroxyethyl)-glycine, N-(1,2-dicarboxy-2-hydroxyethyl-glycine, N-(1,2-dicarboxy-2-hydroxyethyl)-aspartic acid or nitrilotriacetic acid (NTA),
c) geminal diphosphonic acids, such as 1-hydroxyethane-1,1-diphosphonic acid (HEDP), higher homologs thereof containing up to 8 carbon atoms and hydroxyfunctional or aminofunctional derivatives thereof and 1-aminoethane-1,1-diphosphonic acid, higher homologs thereof containing up to 8 carbon atoms and hydroxyfunctional or aminofunctional derivatives thereof,
d) aminophosphonic acids, such as ethylenediamine tetra (methylene-phophonic acid), diethylenetriamine penta (methylenephosphonic acid) or nitrilotri(methylenephosphonic acid),
e) phosphonopolycarboxylic acids, such as 2-phosphonobutane-1,2,4-tricarboxylic acid, and
f) cyclodextrins.

In the context of the present invention, polycarboxylic acids a) are also understood to encompass carboxylic acids and monocarboxylic acids where the sum of carboxyl groups and the hydroxyl groups present in the molecule is at least 5. Complexing agents from the group of nitrogen-containing polycarboxylic acids, more especially EDTA, are preferred. These complexing agents are at least partly present as anions at the alkaline pH values of the treatment solutions required in accordance with the invention. It does not matter whether they are introduced in the form of the acids or in the form of salts. Where they are used in the form of salts, alkali metal, ammonium or alkylammonium salts, especially sodium salts, are preferred.

The scale-inhibiting polymers as ingredient b) are, in particular, one or more scale-inhibiting polymers from the group of cationic homo- or copolymers, more particularly hydroxypropyl trimethyl ammonium guar; copolymers of aminoethyl methacrylate and acrylamide, copolymers of dimethyl diallyl ammonium chloride and acrylamide, polymers containing imino groups, polymers containing quaternized ammonium alkyl methacrylate groups as monomer units, cationic polymers of such monomers as trialkylammonium alkyl(meth)acrylate or acrylamide; dialkyl diallyl ammonium salts; polymer-analog reaction products of ethers or esters of polysaccharides containing ammonium side groups, more particularly guar, cellulose and starch derivatives; polyadducts of ethylene oxide containing ammonium groups; quaternary ethyleneimine polymers and polyesters and polyamides containing quaternary side groups.

Certain copolymers containing sulfonic acid groups represent another preferred ingredient b). Thus, other preferred foams according to the invention are characterized in that they contain as ingredient b) one or more copolymers of i) unsaturated carboxylic acids,
ii) monomers containing sulfonic acid groups,
iii) optionally other ionic or nonionic monomers.

According to the invention, preferred monomers are unsaturated carboxylic acids corresponding to formula (X):

$$R^1(R^2)C{=}C(R^3)COOH \qquad (X)$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms.

Among the unsaturated carboxylic acids corresponding to formula (I), acrylic acid ($R^1{=}R^2{=}R^3{=}H$), methacrylic acid ($R^1{=}R^2{=}H; R^3{=}CH_3$) and/or maleic acid ($R^1{=}COOH; R^2{=}R^3{=}H$) are particularly preferred.

Preferred monomers containing sulfonic acid groups correspond to formula (XI):

$$R^5(R^6)C{=}C(R^7)—X—SO_3H \qquad (XI)$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—.

Among these monomers, those corresponding to formulae (XIa), (XIb) and/or (XIc):

$$H_2C{=}CH—X—SO_3H \qquad (XIa)$$

$$H_2C{=}C(CH_3)—X—SO_3H \qquad (XIb)$$

$$HO_3S—X—(R_6)C{=}C(R^7)—X—SO_3H \qquad (XIc)$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—, are preferred Particularly preferred monomers containing sulfonic acid groups are 1-acrylamido-1-propanesulfonic acid (X=—C(O)NH—CH$(CH_2CH_3)$ in formula (XIa)), 2-acrylamido-2-propanesulfonic acid (X=—C(O)NH—$C(CH_3)_2$ in formula (XIa)), 2-acrylamido-2-methyl-1-propanesulfonic acid (X=—C(O)NH—CH$(CH_3)CH_2$— in formula XIa)), 2-methacrylamido-2-methyl-1-propanesulfonic acid (X=—

C(O)NH—H($CH_3$)$CH_2$— in formula (XIb)), 3-methacrylamido-2-hydroxypropanesulfonic acid (X=—C(O)NH—$CH_2$OH(OH)$CH_2$— in formula (XIb)), allyl sulfonic acid (X=$CH_2$ in formula (XIa)), methallylsulfonic acid (X=$CH_2$ in formula (XIb)), allyloxybenzenesulfonic acid (X=—$CH_2$—O—$C_6H_4$— in formula (XIa)), meth-allyloxybenzenesulfonic acid (X=—$CH_2$—O—$C_6H_4$— in formula (XIb)), 2-hydroxy-3-(2-propenyloxy)-propanesulfonic acid, 2-methyl-2-propene-1-sulfonic acid (X=$CH_2$ in formula (XIb)), styrenesulfonic acid (X=$C_6H_4$ in formula (XIa)), vinylsulfonic acid (X not present in formula (XIa)), 3-sulfopropylacrylate (X=—C(O)NH—$CH_2CH_2CH_2$— in formula (XIa)), 3-sulfopropylmethacyrlate (X=—C(O)NH—$CH_2CH_2CH_2$— in formula (XIb)), sulfomethacrylamide (X=—C(O)NH— in formula (XIb)), sulfomethylmethacrylamide acrylamide (X=—C(O)NH—$CH_2$— in formula (XIb)) and water-soluble salts of the acids mentioned.

Suitable other ionic or nonionic monomers are, in particular, ethylenically unsaturated compounds. The polymers used in accordance with the invention preferably contain less than 20% by weight, based on polymer, of monomers belonging to group iii). Particularly preferred polymers consist solely of monomers belonging to groups i) and ii).

Particularly preferred foams contain as ingredient b) one or more copolymers of i) one or more unsaturated carboxylic acids from the group consisting of acrylic acid, methacrylic acid and/or maleic acid, ii) one or more monomers containing sulfonic acid groups corresponding to formula (XIa), (XIb) and/or (XIc):

$$H_2C{=}CH{-}X{-}SO_3H \quad \text{(XIa)}$$

$$H_2C{=}C(CH_3){-}X{-}SO_3H \quad \text{(XIb)}$$

$$HO_3S{-}X{-}(R_6)C{=}C(R^7){-}X{-}SO_3H \quad \text{(XIc)}$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH($CH_2CH_3$)—, iii) optionally other ionic or nonionic monomers.

The copolymers may contain the monomers belonging to groups i) and ii) and optionally iii) in varying quantities, all representatives of group i) being combinable with all representatives of group ii) and all representatives of group iii). Particularly preferred polymers contain certain structural units which are described in the following.

For example, a preferred foam according to the invention contains one or more copolymers containing structural units corresponding to formula (XII):

$$-[CH_2{-}CHCOOH]_m{-}[CH_2{-}CHC(O){-}Y{-}SO_3H]_p{-} \quad \text{(XII)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH($CH_2CH_3$)— being preferred.

These polymers are produced by copolymerization of acrylic acid with an acrylic acid derivative containing sulfonic acid groups. If the acrylic acid derivative containing sulfonic acid groups is copolymerized with methacrylic acid, another polymer is obtained which is also preferably used as ingredient b) of the foams according to the invention and which is characterized in that one or more copolymers are used which contain structural units corresponding to formula (XIII):

$$-[CH_2{-}C(CH_3)COOH]_m{-}[CH_2{-}CHC(O){-}Y{-}SO_3H]_p{-} \quad \text{(XIII)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH($CH_2CH_3$)— being preferred.

Entirely analogously, acrylic acid and/or methacrylic acid may also be copolymerized with methacrylic acid derivatives containing sulfonic acid groups, so that the structural units in the molecule are changed. Thus, foams according to the invention which contain as ingredient b) one or more copolymers containing structural units corresponding to formula (XIV):

$$-[CH_2{-}CHCOOH]_m{-}[CH_2{-}C(CH_3)C(O){-}Y{-}SO_3H]_p{-} \quad \text{(XIV)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH($CH_2CH_3$)— being preferred, represent another preferred embodiment of the invention, as do foams which are characterized in that they contain as ingredient b) one or more copolymers containing structural units corresponding to formula (XV):

$$-[CH_2{-}C(CH_3)COOH]_m{-}[CH_2{-}C(CH_3)C(O){-}Y{-}SO_3H]_p{-} \quad \text{(XV)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH($CH_2CH_3$)— being preferred.

Maleic acid may also be used as a particularly preferred group i) monomer instead of or in addition to acrylic acid and/or methacrylic acid. In this way, it is possible to obtain preferred copolymers according to the invention containing structural units corresponding to formula (XVI):

$$-[HOOCCH{-}CHCOOH]_m{-}[CH_2{-}CHC(O){-}Y{-}SO_3H]_p{-} \quad \text{(XVI)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—CH($CH_2CH_3$)— being preferred, and foams which are characterized in that they contain as ingredient b) one or more copolymers containing structural units corresponding to formula (XVII):

$$-[HOOCCH{-}CHCOOH]_m{-}[CH_2{-}C(CH_3)C(O)O{-}Y{-}SO_3H]_p{-} \quad \text{(XVII)}$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents —O—$(CH_2)_n$— with n=0 to 4, —O—$(C_6H_4)$—, —NH—$C(CH_3)_2$— or —NH—$CH(CH_2CH_3)$— being preferred.

The sulfonic acid groups may be present in the polymers completely or partly in neutralized form, i.e. the acidic hydrogen atom of the sulfonic acid groups being replaceable by metal ions, preferably alkali metal ions and more particularly sodium ions, in some or all of the sulfonic acid groups. Corresponding solid foams characterized in that the sulfonic acid groups in the copolymer are present in partly or fully neutralized form represent a preferred embodiment of the invention.

In the case of copolymers which only contain group i) and group ii) monomers, the monomer distribution in the copolymers preferably used as ingredient b) in accordance with the invention is preferably 5 to 95% by weight i) or ii) and more preferably 50 to 90% by weight group i) monomer and 10 to 50% by weight group ii) monomer, based in each case on the monomer.

Particularly preferred terpolymers contain 20 to 85% by weight group i) monomer, 10 to 60% by weight group ii) monomer and 5 to 30% by weight group iii) monomer.

The molecular weight of the polymers preferably used in accordance with the invention may be varied in order to adapt the properties of the polymers to the particular application envisaged. Preferred foams are characterized in that the copolymers have molecular weights of 2,000 to 200,000 $gmol^{-1}$, preferably in the range from 4,000 to 25,000 $gmol^{-1}$ and more particularly in the range from 5,000 to 15,000 $gmol^{-1}$.

Another class of substances suitable as ingredient b) in the solid foams according to the invention are nonionic surfactants. Here, preferred foams according to the invention contain 12.5 to 55% by weight, preferably 15 to 50% by weight, more preferably 17.5 to 45% by weight and most preferably 20 to 40% by weight of one or more nonionic surfactants as ingredient b).

In particularly preferred embodiments of the present invention, the foam according to the invention contains nonionic surfactants from the group of alkoxylated alcohols as ingredient b). Preferred nonionic surfactants are alkoxylated, advantageously ethoxylated, more especially primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may contain linear and methyl-branched groups in the form of the mixtures typically present in oxoalcohol groups. However, alcohol ethoxylates containing linear groups of alcohols of native origin with 12 to 18 carbon atoms, for example coconut, palm, tallow or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Preferred other nonionic surfactants are propoxylated and/or butoxylated nonionic surfactants, particular significance attaching to the mixed alkoxylated, advantageously propoxylated and ethoxylated nonionic surfactants. In these nonionic surfactants, too, the C chain length in the alkyl group is preferably 8 to 18 carbon atoms, particular significance attaching to $C_{9-11}$ alkyl groups, $C_{12-13}$ alkyl groups and $C_{16-18}$ alkyl groups. Nonionic surfactants obtained from $C_{9-11}$ or $C_{12-13}$ oxoalcohols are particularly preferred. With the preferred nonionic surfactants, an average of 1 to 20 moles alkylene oxide (AO) is used per mole of alcohol, AO standing for the sum of EO and PO. Particularly preferred nonionic surfactants of this group contain 1 to 5 moles PO and 5 to 15 moles EO. A particularly preferred representative of this group is a $C_{12-20}$ oxoalcohol alkoxylated with 2 PO and 15 EO which is commercially available as Plurafac® LF 300 (BASF).

Instead of or in addition to PO groups, preferred nonionic surfactants may also contain butylene oxide groups. The alkyl groups mentioned above, particularly the oxoalcohol radicals, are again preferred. The number of BO groups in preferred nonionic surfactants is 1, 2, 3, 4 or 5, the total number of alkylene oxide groups preferably being in the range from 10 to 25. A particularly preferred representative of this group is commercially obtainable as Plurafac® LF 221 (BASF) and corresponds to the formula $C_{13-15}$—O-$(EO)_{9-10}(BO)_{1-2}$.

Suitable other nonionic surfactants are alkyl glycosides with the general formula $RO(G)_x$ where R is a primary, linear or methyl-branched, more particularly 2-methyl-branched, aliphatic radical containing 8 to 22 and preferably 12 to 18 carbon atoms and G stands for a glycose unit containing 5 or 6 carbon atoms, preferably glucose. The degree of oligomerization x, which indicates the distribution of monoglycosides and oligoglycosides, is a number of 1 to 10 and preferably 1.2 to 1.4.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially fatty acid methyl esters.

Nonionic surfactants of the amine oxide type, for example N-coconutalkyl-N,N-dimethylamine oxide and N-tallow-alkyl-N,N-dihydroxy-ethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (XVIII):

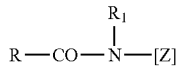

(XVIII)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (XIX):

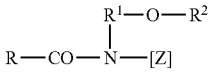

(XIX)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxy-alkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

In a particularly preferred embodiment, the foams according to the invention contain a nonionic surfactant which has a melting point above room temperature. Preferred foams contains (a) nonionic surfactant(s) with a melting point above 20° C., preferably above 25° C., more preferably between 25 and 60° C. and, more particularly, between 26.6 and 43.3° C. in quantities of 10 to 55% by weight, preferably 15 to 50% by weight, more preferably 20 to 45% by weight and, more particularly, 25 to 40% by weight, based on the composition as a whole.

Suitable nonionic surfactants with melting or softening points in the temperature range mentioned above are, for example, low-foaming nonionic surfactants which may be solid or highly viscous at room temperature. If nonionic surfactants highly viscous at room temperature are used, they preferably have a viscosity above 20 Pas, more preferably above 35 Pas and most preferably above 40 Pas. Nonionic surfactants which are wax-like in consistency at room temperature are also preferred.

Nonionic surfactants solid at room temperature preferably used in accordance with the invention belong the groups of alkoxylated nonionic surfactants, more particularly ethoxylated primary alcohols, and mixtures of these surfactants with structurally complex surfactants, such as polyoxypropylene/polyoxyethylene/polyoxypropylene (PO/EO/PO) surfactants. In addition, (PO/EO/PO) nonionic surfactants are distinguished by good foam control.

In one preferred embodiment of the present invention, the nonionic surfactant with a melting point above room temperature is an ethoxylated nonionic surfactant emanating from the reaction of a monohydroxyalkanol or alkylphenol containing 6 to 20 carbon atoms with preferably at least 12 moles, more preferably at least 15 moles and most preferably at least 20 moles of ethylene oxide per mole of alcohol or alkylphenol. Accordingly, corresponding foams which are characterized in that the nonionic surfactant(s) is/are ethoxylated nonionic surfactant(s) obtained from $C_{6-20}$ monohydroxyalkanols or $C_{6-20}$ alkylphenols or $C_{16-20}$ fatty alcohols and more than 12 moles, preferably more than 15 moles and more particularly more than 20 moles ethylene oxide per mole alcohol are preferred.

A particularly preferred nonionic surfactant solid at room temperature is obtained from a straight-chain fatty alcohol containing 16 to 20 carbon atoms ($C_{16-20}$ alcohol), preferably a $C_{18}$ alcohol, and at least 12 moles, preferably at least 15 moles and more preferably at least 20 moles of ethylene oxide. Of these nonionic surfactants, the so-called narrow range ethoxylates (see above) are particularly preferred.

The nonionic surfactant solid at room temperature preferably also contains propylene oxide units in the molecule. These PO units preferably make up as much as 25% by weight, more preferably as much as 20% by weight and, most preferably, up to 15% by weight of the total molecular weight of the nonionic surfactant. Particulate dishwasher detergents containing ethoxylated and propoxylated nonionic surfactants where the propylene oxide units in the molecule make up as much as 25% by weight, preferably 20% by weight and more particularly 15% by weight of the total molecular weight of the nonionic surfactant represent preferred embodiments of the present invention. Particularly preferred nonionic surfactants are ethoxylated monohydroxyalkanols or alkylphenols which additionally contain polyoxyethylene/polyoxypropylene block copolymer units. The alcohol or alkylphenol component of these nonionic surfactant molecules preferably makes up more than 30% by weight, more preferably more than 50% by weight and most preferably more than 70% by weight of the total molecular weight of these nonionic surfactants.

Other particularly preferred nonionic surfactants with melting points above room temperature contain 40 to 70% of a polyoxypropylene/polyoxyethylene/polyoxpropylene block polymer blend which contains 75% by weight of an inverted block copolymer of polyoxyethylene and polyoxypropylene with 17 moles of ethylene oxide and 44 moles of propylene oxide and 25% by weight of a block copolymer of polyoxyethylene and polyoxy-propylene initiated with trimethylol propane and containing 24 moles of ethylene oxide and 99 moles of propylene oxide per mole of trimethylol propane.

Nonionic surfactants which may be used with particular advantage are obtainable, for example, under the name of Poly Tergent® SLF-18 from Olin Chemicals.

Another preferred surfactant may be described by the following formula:

$$R^1O[CH_2CH(CH_3)O]_x[CH_2CH_2O]_y[CH_2CH(OH)R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5 and y has a value of at least 15. Accordingly, particulate dishwasher detergents which are characterized in that they contain nonionic surfactants corresponding to the following formula:

$$R^1O[CH_2CH(CH_3)O]_x[CH_2CH_2O]_y[CH_2CH(OH)\ R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5 and y has a value of at least 15, are preferred.

Other preferred nonionic surfactants are the end-capped poly(oxy-alkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5. Where x has a value of ≧2, each substituent $R^3$ in the above formula may be different. $R^1$ and $R^2$ are preferably linear or branched, saturated or unsaturated, aliphatic or aromatic hydrocarbon radicals containing 6 to 22 carbon atoms, radicals containing 8 to 18 carbon atoms being particularly preferred. For the substituent $R^3$, H, —$CH_3$ or —$CH_2CH_3$ are particularly preferred. Particularly preferred values for x are in the range from 1 to 20 and more particularly in the range from 6 to 15.

As mentioned above, each substituent $R^3$ in the above formula may be different where x is ≧2. In this way, the alkylene oxide unit in the square brackets can be varied. If, for example, x has a value of 3, the substituent $R^3$ may be selected to form ethylene oxide ($R^3$=H) or propylene oxide ($R^3$=$CH_3$) units which may be joined together in any order, for example (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to:

$$R^1O[CH_2CH(R^3)O]_xCH_2CH(OH)CH_2OR^2$$

In this formula, $R^1$, $R^2$ and $R^3$ are as defined above and x has a value of 1 to 30, preferably 1 to 20 and more preferably 6 to 18. Surfactants in which the substituents $R^1$ and $R^2$ have 9 to 14 carbon atoms, $R^3$ stands for H and x has a value of 6 to 15 are particularly preferred.

To sum up, preferred foams are those which contain as ingredient b) end-capped poly(oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5, surfactants of the following type:

$$R^1O[CH_2CH(R^3)O]_xCH_2CH(OH)CH_2OR^2$$

where x has a value of 1 to 30, preferably 1 to 20 and more preferably 6 to 18, being particularly preferred.

Mixtures of different nonionic surfactants are used with particular advantage in the foams according to the invention. In this case, mixtures of a) nonionic surfactants from the group of alkoxylated alcohols, b) nonionic surfactants from the group of alkoxylated alcohols containing hydroxyl groups ("hydroxy mixed ethers")

are particularly preferred as ingredient b).

The group a) nonionic surfactants are described in detail in the foregoing, $C_{12-14}$ fatty alcohols containing 5EO and 4PO and $C_{12-18}$ fatty alcohols containing on average 9EO having proved to be outstanding. End-capped nonionic surfactants, particularly $C_{12-18}$ fatty alcohol 9 EO butyl ether, may also be used with similar advantage.

Group b) surfactants show, for example, outstanding clear-rinse effects and reduce stress cracking in plastics. They also have the advantageous property that their wetting behavior is constant over the entire usual temperature range. In a particularly preferred embodiment, the group b) surfactants are alkoxylated alcohols containing hydroxyl groups.

End-capped surfactants and nonionic surfactants containing butyloxy groups may also be used with advantage as nonionic surfactants in accordance with the invention. The first group encompasses in particular representatives corresponding to the following formula:

$$R^1O[CH_2CH(R^3)O]_xR^2$$

in which $R^1$ is a linear or branched, saturated or unsaturated, aliphatic or aromatic hydrocarbon radical containing 1 to 30 carbon atoms, $R^2$ is a linear or branched, saturated or unsaturated, aliphatic or aromatic hydrocarbon radical containing 1 to 30 carbon atoms which may optionally be substituted by 1, 2, 3, 4 or 5 hydroxy groups and optionally by other ether groups, $R^3$ represents —H or methyl, ethyl, n-propyl, isopropyl, n-butyl, isobutyl or tert.butyl and x may assume a value of 1 to 40. $R^2$ may optionally be alkoxylated, the alkoxy group preferably being selected from ethoxy, butoxy, butyloxy groups and mixtures thereof.

Preferred surfactants corresponding to the above general formula are those in which $R^1$ is a $C_{9-11}$ or $C_{11-15}$ alkyl group, $R^3$=H and x is a value of 8 to 15 whereas $R^2$ is preferably a linear or branched saturated alkyl group. Particularly preferred surfactants may be represented by the formulae $C_{9-11}(EO)_8$-$C(CH_3)_2CH_2CH_3$, $C_{11-15}(EO)_{15}(PO)_6$-$C_{12-14}$, $C_{9-11}(EO)_8(CH_2)_4CH_3$.

Other particularly preferred surfactants are mixed-alkoxylated surfactants, those containing butyloxy groups being preferred. Surfactants such as these may be represented by the following formula:

$$R^1(EO)_a(PO)_b(BO)_c$$

in which $R^1$ is a linear or branched, saturated or unsaturated, aliphatic or aromatic hydrocarbon radical containing 1 to 30 and preferably 6 to 20 carbon atoms, a has a value of 2 to 30, b has a value of 0 to 30 and c has a value of 1 to 30 and preferably 1 to 20.

Alternatively, the EO and PO groups in the above formula may also be interchanged so that surfactants corresponding to the following general formula:

$$R^1(PO_b(EO)_a(BO)_c$$

in which $R^1$ is a linear or branched, saturated or unsaturated, aliphatic or aromatic hydrocarbon radical containing 1 to 30 and preferably 6 to 20 carbon atoms, a has a value of 2 to 30, b has a value of 0 to 30 and c has a value of 1 to 30 and preferably 1 to 20, may also be used with advantage.

Particularly preferred representatives from this group of surfactants may be represented by the formulae $C_{9-11}(PO)_3$ $(EO)_{13}(BO)_{15}$, $C_{9-11}(PO)_3(EO)_{13}(BO)_6$, $C_{9-11}(PO)_3(EO)_{13}(BO)_3$, $C_{9-11}(EO)_{13}(BO)_6$, $C_{9-11}(EO)_{13}(BO)_3$, $C_{9-11}(PO)(EO)_{13}(BO)_3$, $C_{9-11}(EO)_8(BO)_3$, $C_{9-11}(EO)_8(BO)_2$, $C_{12-15}(EO)_7(BO)_2$, $C_{9-11}(EO)_8(BO)_2$, $C_{9-11}(EO)_8(BO)$. A particularly prefer surfactant with the formula $C_{13-15}(EO)_{9-10}(BO)_{1-2}$ is commercially obtainable as Plurafac® LF 221. Another particularly preferred surfactant containing 10 EO and 2 BO is available under the name of Genapol® 25 EB 102. A surfactant with the formula $C_{12-13}(EO)_{10}(BO)_2$ may also be used with advantage.

Besides the above-mentioned ingredient(s) a) (water-soluble polymer) and b) (substance from the group of builders, acidifying agents, chelating agents, scale-inhibiting polymers and nonionic surfactants), the solid foams according to the invention may also contain other auxiliaries and/or fillers. In preferred foams according to the invention, these auxiliaries and/or fillers belong to the groups of dyes and perfumes, fillers, binders, humectants and/or salts.

In order to improve their aesthetic impression, the foams according to the invention may be colored with suitable dyes. Preferred dyes, which are not difficult for the expert to choose, have high stability in storage, are not affected by the other ingredients of the detergents or by light and do not have any pronounced substantivity for textile fibers so as not to color them.

In selecting the dye, it is important to ensure that the dye does not have an excessive affinity for the surfaces. Another factor to be taken into account in the selection of suitable dyes is that dyes differ in their stability to oxidation. Generally speaking, water-insoluble dyes are more stable to oxidation than water-soluble dyes. The concentration of the dye in the detergents varies according to its solubility and hence its sensitivity to oxidation. In the case of readily water-soluble dyes, for example the above-mentioned Basacid® Grün and Sandolan® Blau, dye concentrations in the range from a few $10^{-2}$ to $10^{-3}$% by weight are typically selected. By contrast, in the case of the pigment dyes which are particularly preferred for their brilliance, but which are less readily soluble in water, for example the Pigmosol® dyes, suitable concentrations of the dye in detergents are typically of the order of a few $10^{-3}$ to $10^{-4}$% by weight.

Perfumes are added to the foams according to the invention in order to improve the aesthetic impression created by the products and to provide the consumer not only with the required performance but also with a visually and sensorially "typical and unmistakable" product. Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and ladanum oil and orange blossom oil, neroli oil, orange peel oil and sandalwood oil.

The perfume content of the foams according to the invention is normally up to 2% by weight, based on the formulation as a whole. The perfumes may be directly incorporated in the foams according to the invention, although it can also be of advantage to apply the perfumes to supports which strengthen the adherence of the perfume to the washing or to other treated substrates and which provide for a long-lasting fragrance through a slower release of the perfume. Suitable support materials are, for example, cyclodextrins, the cyclodextrin/perfume complexes optionally being coated with other auxiliaries.

Binders and humectants may also be part of the foams according to the invention as ingredient c). The contents of binders/humectants is normally between 0.5 and 10% by weight, preferably between 0.75 and 7.5% by weight and more particularly between 1 and 5% by weight, based on the solid foam as a whole.

Suitable salts are, in particular, readily soluble salts, particularly referred salts having solubilities above 200 grams salt in one liter deionized water at 20° C. Suitable preferred salts such as these for incorporation in the foams according to the invention are any of a large n umber of compounds. The salts preferably have even higher solubilities so that preferred salts are characterized in that they have a solubility of more than 250 g per liter of water at 20° C., preferably more than 300 g per liter of water at 20° C. and, more particularly, more than 350 g per liter of water at 20° C.

The solid foams may be made up as part of a detergent and, in this case, may be combined with other constituents to form a ready-to-use detergent, more particularly in the form of shaped bodies, i.e. laundry detergent tablets, cleaning tablets or special supply forms, such as bleaching tablets or stain removing tablets. In this case, conventional tablets, i.e. tablets produced by press technology, may be combined with solid foams according to the invention which then represent a differentiated, even visually differentiated, tablet phase.

The solid foams according to the invention may also be formulated as detergents in their own right. To this end, ingredient c) is selected from ingredients which perform important functions in the washing/cleaning process, i.e. mainly surfactants from other classes (particularly anionic and/or cationic surfactants), cobuilders, bleaching agents, bleach activators, enzymes, optical brighteners, silver protectors, etc. which are described briefly in the following.

Organic cobuilders which may be used in the forms include, in particular, polycarboxylates/polycarboxylic acids, polymeric polycarboxylates, aspartic acid, polyacetals, dextrins, other organic cobuilders (see below) and phosphonates. These classes of substances are described in the following.

Other suitable builders are polymeric polycarboxylates, i.e. for example the alkali metal salts of polyacrylic or polymethacrylic acid, for example those with a relative molecular weight of 500 to 70,000 g/mole.

The molecular weights mentioned in this specification for polymeric polycarboxylates are weight-average molecular weights $M_w$ of the particular acid form which, basically, were determined by gel permeation chromatography (GPC) using a UV detector. The measurement was carried out against an external polyacrylic acid standard which provides realistic molecular weight values by virtue of its structural similarity to the polymers investigated. These values differ distinctly from the molecular weights measured against polystyrene sulfonic acids as standard. The molecular weights measured against polystyrene sulfonic acids are generally higher than the molecular weights mentioned in this specification.

Particularly suitable polymers are polyacrylates which preferably have a molecular weight of 2,000 to 20,000 g/mole. By virtue of their superior solubility, preferred representatives of this group are the short-chain polyacrylates which have molecular weights of 2,000 to 10,000 g/mole and, more particularly, 3,000 to 5,000 g/mole.

Also suitable are copolymeric polycarboxylates, particularly those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weights, based on the free acids, are generally in the range from 2,000 to 70,000 g/mole, preferably in the range from 20,000 to 50,000 g/mole and more preferably in the range from 30,000 to 40,000 g/mole.

The (co)polymeric polycarboxylates may be used either in powder form or in the form of an aqueous solution. The content of (co)polymeric polycarboxylates in the foams is preferably 0.5 to 20% by weight and more particularly 3 to 10% by weight.

In order to improve solubility in water, the polymers may also contain allyl sulfonic acids such as, for example, allyloxybenzene sulfonic acid and methallyl sulfonic acid as monomer.

Other particularly preferred polymers are biodegradable polymers of more than two different monomer units, for example those which contain salts of acrylic acid and maleic acid and vinyl alcohol or vinyl alcohol derivatives as monomers or those which contain salts of acrylic acid and 2-alkylallyl sulfonic acid and sugar derivatives as monomers.

Other preferred copolymers are those which preferably contain acrolein and acrylic acid/acrylic acid salts or acrolein and vinyl acetate as monomers.

Other preferred builders are polymeric aminodicarboxylic acids, salts or precursors thereof. Polyaspartic acids or salts and derivatives thereof which have a bleach-stabilizing effect besides their cobuilder properties are particularly preferred.

Other suitable builders are polyacetals which may be obtained by reaction of dialdehydes with polyol carboxylic acids containing 5 to 7 carbon atoms and at least three hydroxyl groups. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000 g/mol. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 g/mole may be used.

The oxidized derivatives of such dextrins are their reaction products with oxidizing agents which are capable of oxidizing at least one alcohol function of the saccharide ring to the carboxylic acid function. An oxidized oligosaccharide is also suitable. A product oxidized at $C_6$ of the saccharide ring can be particularly advantageous.

Other suitable co-builders are oxydisuccinates and other derivatives of disuccinates, preferably ethylenediamine disuccinate. Ethylenediamine-N,N'-disuccinate (EDDS) is preferably used in the form of its sodium or magnesium salts. Glycerol disuccinates and glycerol trisuccinates are also preferred in this connection. The quantities used in zeolite-containing and/or silicate-containing formulations are from 3 to 15% by weight.

Other useful organic co-builders are, for example, acetylated hydroxycarboxylic acids and salts thereof which may optionally be present in lactone form and which contain at least 4 carbon atoms, at least one hydroxy group and at most two acid groups.

Another class of substances with co-builder properties are the phosphonates, more particularly hydroxyalkane and aminoalkane phosphonates. Among the hydroxyalkane phosphonates, 1-hydroxyethane-1,1-diphosphonate (HEDP) is particularly important as a co-builder. It is preferably used in the form of the sodium salt, the disodium salt showing a neutral reaction and the tetrasodium salt an alkaline reaction (pH 9). Preferred aminoalkane phosphonates are ethylenediamine tetramethylene phosphonate (EDTMP), diethylenetriamine pentamethylenephosphonate (DTPMP) and higher homologs thereof. They are preferably used in the form of the neutrally reacting sodium salts, for example as the hexasodium salt of EDTMP or as the hepta- and octasodium salts of DTPMP. Of the phosphonates, HEDP is preferably used as a builder. In addition, the aminoalkane phosphonates have a pronounced heavy metal binding capacity. Accordingly, it can be of advantage, particularly where the foams also contain bleach, to use aminoalkane phosphonates, more particularly DTPMP, or mixtures of the phosphonates mentioned.

In addition, any compounds capable of forming complexes with alkaline earth metal ions may be used as co-builders.

The anionic surfactants used as ingredient c) of the foams according to the invention may be, for example, those of the sulfonate and sulfate type. Preferred surfactants of the sulfonate type are $C_{9-13}$ alkyl benzenesulfonates, olefin sulfonates, i.e. mixtures of alkene and hydroxy-alkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of $\alpha$-sulfofatty acids (ester sulfonates), for example the $\alpha$-sulfonated methyl esters of hydrogenated coconut oil, palm kernel oil or tallow fatty acids, are also suitable.

Other suitable anionic surfactants are sulfonated fatty acid glycerol esters, i.e. the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated $C_{6-22}$ fatty acids, for example caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example coconut alcohol, tallow alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates and $C_{12-15}$ alkyl sulfates and also $C_{14-15}$ alkyl sulfates are particularly preferred from the washing performance point of view. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN).

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are normally used in only relatively small quantities, for example in quantities of 1 to 5% by weight, in dishwashing detergents.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol molecules or mixtures thereof. Particularly preferred sulfosuccinates contain a fatty alcohol molecule derived from ethoxylated fatty alcohols which, considered in isolation, represent nonionic surfactants (for a description, see below). Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Besides the constituents mentioned, the foams according to the invention may contain other typical detergent ingredients from the group of bleaching agents, bleach activators, optical brighteners, enzymes, foam inhibitors, silicone oils, redeposition inhibitors, discoloration inhibitors, dye transfer inhibitors and corrosion inhibitors.

To develop the required bleaching performance, the foams according to the invention may contain bleaching agents. The usual bleaching agents from the group consisting of sodium perborate monohydrate, sodium perborate tetrahydrate and sodium percarbonate have proved to be particularly effective, sodium percarbonate being distinctly preferred.

"Sodium percarbonate" is a non-specific term used for sodium carbonate peroxohydrates which, strictly speaking, are not "percarbonates" (i.e. salts of percarbonic acid), but hydrogen peroxide adducts with sodium carbonate. The commercial material has the mean composition $2\ Na_2CO_3.3H_2O_2$ and, accordingly, is not a peroxycarbonate. Sodium percarbonate forms a white water-soluble powder with a density of 2.14 $gcm^{-3}$ which readily decomposes into sodium carbonate and bleaching or oxidizing oxygen.

Sodium carbonate peroxohydrate was obtained for the first time in 1899 by precipitation with ethanol from a solution of sodium carbonate in hydrogen peroxide, but was mistakenly regarded as peroxycarbonate. It was only in 1909 that the compound was recognised as a hydrogen peroxide addition compound. Nevertheless, the historical name "sodium percarbonate" has been adopted in practice.

On an industrial scale, sodium percarbonate is mainly produced by precipitation from aqueous solution (so-called wet process). In this process, aqueous solutions of sodium carbonate and hydrogen peroxide are combined and the sodium percarbonate is precipitated by salting-out agents (mainly sodium chloride), crystallization aids (for example polyphosphates, polyacrylates) and stabilizers (for example $Mg^{2+}$ions). The precipitated salt which still contains 5 to 12% by weight of mother liquor is then removed by centrifuging and dried at 90° C. in fluidized bed dryers. The bulk density of the end product can vary between 800 and 1200 g/l according to the production process. In general, the percarbonate is stabilized by an additional coating. Coating processes and materials are widely described in the patent literature. Basically, any commercially available percarbonate types as marketed, for example, by Solvay Interox, Degussa, Kemira and Akzo may be used in accordance with the present invention.

The content of the bleaching agents used in the foams is dependent upon the particular application envisaged. Whereas standard heavy-duty detergents contain between 5 and 30% by weight, preferably between 7.5 and 25% by weight and more particularly between 12.5 and 22.5% by weight of bleaching agent, the contents of bleaching or bleach booster preparations are between 15 and 50% by weight, preferably between 22.5 and 45% by weight and more particularly between 30 and 40% by weight.

In addition to the bleaching agents used, the foams according to the invention may contain bleach activator(s) in a preferred embodiment of the invention. Bleach activators are incorporated in detergents in order to obtain an improved bleaching effect where washing is carried out at temperatures of or below 60° C. Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated. These substances are bleach-boosting transition metal salts or transition metal complexes such as, for example, manganese-, iron-, cobalt-, ruthenium- or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

If the foams according to the invention contain bleach activators, they contain between 0.5 and 30% by weight, preferably between 1 and 20% by weight and more particularly between 2 and 15% by weight, based on the foam as a whole, of one or more bleach activators or bleach catalysts. These quantities may vary according to the application envisaged for the foams produced. Thus, in typical heavy-duty detergents, bleach activator contents of 0.5 to 10% by weight, preferably 2 to 8% by weight and more particularly 4 to 6% by weight are normal whereas bleaching preparations can have much higher contents, for example of 5 to 30% by weight, preferably 7.5 to 25% by weight and more particularly 10 to 20% by weight. The expert is not limited in his freedom of formulation in this regard and can thus produce detergents, cleaners or bleaching preparations with a relatively strong or relatively weak bleaching effect by varying the contents of bleach activator and bleaching agent.

A particularly preferred bleach activator is N,N,N',N'-tetraacetyl ethylenediamine which is widely used in detergents. Accordingly, preferred foams are characterized in that tetraacetyl ethylenediamine in the above-mentioned quantities is used as bleach activator.

The foams may contain derivatives of diaminostilbenedisulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used. The optical brighteners are used as ingredient c) in the foams according to the invention in concentrations of 0.01 to 1% by weight, preferably 0.05 to 0.5% by weight and more preferably 0.1 to 0.25% by weight, based on the foam as a whole.

Suitable enzymes are, in particular, those from the classes of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discoloration in the washing process. Cellulases and other glycosyl hydrolases can contribute towards color retention and towards increasing fabric softness by removing pilling and microfibrils. Oxidoreductases may also be used for bleaching and for inhibiting dye transfer. Enzymes obtained from bacterial strains or fungi, such as *Bacillus subtilis, Bacillus licheniformis, Streptomyces griseus, Coprinus cinereus* and *Humicola insolens* and from genetically modified variants are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular α-amylases, isoamylases, pullanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios.

The enzymes may be adsorbed to supports and/or encapsulated in membrane materials to protect them against premature decomposition. The percentage content of the enzymes, enzyme mixtures or enzyme granules may be, for example, from about 0.1 to 5% by weight and is preferably from 0.5 to about 4.5% by weight.

In addition, the foams may also contain components with a positive effect on the removability of oil and fats from textiles by washing (so-called soil repellents) as ingredient c). This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Other preferred foams are characterized in that they contain silver protectors selected from the group of triazoles, benzotriazoles, bisbenzotriazoles, aminotriazoles, alkylaminotriazoles and the transition metal salts or complexes, preferably benzotriazole and/or alkylaminotriazole, in quantities of 0.01 to 5% by weight, preferably in quantities of 0.05 to 4% by weight and more particularly in quantities of 0.5 to 3% by weight, based on the weight of the foam, as ingredient c).

The corrosion inhibitors mentioned may be present to protect the tableware or the machine itself, silver protectors being particularly important for dishwashing machines. Known corrosion inhibitors may be used. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. Chlorine-free dishwashing detergents contain in particular oxygen- and nitrogen-containing organic redox-active compounds, such as dihydric and trihydric phenols, for example hydroquinone, pyrocatechol, hydroxyhydroquinone, gallic acid, phloro-glucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, cobalt (ammine) complexes, cobalt(acetate) complexes, cobalt(carbonyl) complexes, chlorides of cobalt or manganese and manganese sulfate being particularly preferred. Zinc compounds may also be used to prevent corrosion of tableware.

Instead of or in addition to water-soluble polymers, the solid partitions of the detergent tablets according to the invention may also consist of other substances. Ideally, the solid partitions in preferred detergent tablets according to the invention or phases thereof consist entirely of detergent ingredients. With certain classes of substances, this is easy to achieve (high-melting nonionic surfactants, organic polymers as cobuilders). Other substances are difficult to convert into a state which enables the solid foam structures to be formed. In cases such as these, a matrix material which is converted into a foamable state together with the active substance in question and foamed is preferably used as an auxiliary. Besides the polymers mentioned (see also further below), suitable matrix materials are the meltable substances described in the following.

Compositions which soften under the effect of heat can easily be produced by mixing the other ingredients required (preferably detergent ingredients) with a meltable or softenable material (referred to above as the matrix material), heating the mixture to temperatures in the softening range of that material and then shaping/forming it to form a foam which is converted by cooling into a solid foam. In a particularly preferred embodiment, waxes, paraffins, polyalkylene glycols, etc. are used as the meltable or softenable substances and are described in the following.

The meltable or softenable substances should have a melting range (solidification range) at temperatures at which the remaining ingredients of the compositions of matrix substance and other ingredients to be processed are not exposed to significant thermal stressing. On the other hand, however, the melting range must be high enough still to provide a tablet (or tablet phase) capable of being handled at least slightly elevated temperatures. In preferred compositions according to the invention, the meltable or softenable substances have a melting point above 30° C.

It has been found to be of advantage if the meltable or softenable substance does not have a sharply defined melting point, as would normally be the case with pure crystalline substances, but rather a melting range possibly covering several degrees Celsius. The meltable or softenable substance preferably has a melting range of about 45° C. to about 75° C. This means in the present case that the melting range lies within the temperature range mentioned and does not denote the width of the melting range. The width of the melting range is preferably at least 1° C. and more preferably about 2 to about 3° C.

The properties mentioned above are generally exhibited by so-called waxes. "Waxes" in the context of the present invention are understood to be any of a number of natural or synthetic substances which generally melt above 40° C. without decomposing and, even just above their melting point, are of relatively low viscosity and non-stringing. Their consistency and solubility are dependent to a large extent on temperature.

Waxes are divided into three groups according to their origin, namely: natural waxes, chemically modified waxes and synthetic waxes.

The natural waxes include, for example, vegetable waxes, such as candelilla wax, carnauba wax, Japan wax, esparto grass wax, cork wax, guaruma wax, rice oil wax, sugar cane wax, ouricury wax or montan wax, animal waxes, such as bees wax, shellac wax, spermaceti, lanolin (wool wax) or uropygial fat, mineral waxes, such as ceresine or ozocerite (earth wax), or petrochemical waxes, such as petrolatum, paraffin waxes or microwaxes.

The chemically modified waxes include, for example, hard waxes, such as montan ester waxes, sassol waxes or hydrogenated jojoba waxes.

Synthetic waxes are generally understood to be polyalkylene waxes or polyalkylene glycol waxes. Compounds from other classes which satisfy the above-mentioned softening point requirements may also be used as the meltable or softenable substances. For example, higher esters of phthalic acid, more particularly the dicyclohexyl phthalate commercially available under the name of Unimoll® 66 (Bayer AG), have proved to be suitable synthetic compounds. Synthetic waxes of lower carboxylic acids and fatty alcohols, for example the dimyristyl tartrate commercially available under the name of Cosmacol® ETLP (Condea), are also suitable. Conversely, synthetic or partly synthetic esters of lower alcohols with fatty acids from native sources may also be used. This class of substances includes, for example, Tegin® 90 (Goldschmidt), a glycerol monostearate palmitate. Shellac, for example Schellack-KPS-Dreiring-SP (Kalkhoff GmbH), may also be used as a meltable or softenable substance in accordance with the invention.

In the context of the invention, the waxes also include, for example, the so-called wax alcohols. Wax alcohols are relatively high molecular weight water-insoluble fatty alcohols generally containing about 22 to 40 carbon atoms. The wax alcohols are used as a principal constituent of many natural waxes, for example in the form of wax esters of relatively high molecular weight fatty acids (wax acids). Examples of wax alcohols are lignoceryl alcohol (1-tetracosanol), cetyl alcohol, myristyl alcohol or melissyl alcohol. The coating of the solid particles coated in accordance with the invention may also contain wool wax alcohols which are understood to be triterpenoid and steroid alcohols, for example the lanolin obtainable, for example, under the name of Argowax® (Pamentier & Co.). According to the invention, fatty acid glycerol esters or fatty acid alkanolamides and also water-insoluble or substantially water-insoluble polyalkylene glycol compounds may also be used at least partly as a constituent of the meltable or softenable substances.

Particularly preferred meltable or softenable substances in the compositions to be processed are those belonging to the group of polyethylene glycols (PEGs) and/or polypropylene glycols (PPGs), polyethylene glycols with molecular weights of 1,500 to 36,000 being preferred, those with molecular weights of 2,000 to 12,000 being particularly preferred and those with molecular weights of 3,000 to 5,000 being most particularly preferred. Corresponding detergent tablets which are characterized in that the cell walls contain at least one substance from the group of polyethylene glycols (PEGs) and/or polypropylene glycols (PPGs) are also preferred. Particularly preferred tablets according to the invention are characterized in that propylene glycols (PPGs) and/or polyethylene glycols (PEGs) are present as sole meltable or softenable substances in the cell walls. These substances were described in detail in the foregoing.

In another preferred embodiment, the cell walls predominantly contain paraffin wax. In other words, at least 50% by weight—and preferably more—of the total of meltable or softenable substances present consists of paraffin wax. Paraffin wax contents (based on total quantity of meltable or softenable substances) of about 60% by weight, about 70% by weight or about 80% by weight are particularly suitable, even higher contents of, for example, more than 90% by weight being particularly preferred. In one particular embodiment of the invention, the total quantity of meltable or softenable substances used in the cell walls consists entirely of paraffin wax.

So far as the present invention is concerned, paraffin waxes have the advantage over the other natural waxes mentioned that the waxes do not undergo hydrolysis in an alkaline detergent environment (as might be expected, for example, in the case of the wax esters), because a paraffin wax does not contain any hydrolyzable groups.

Paraffin waxes consist principally of alkanes and small amounts of iso- and cycloalkanes. The paraffin to be used in accordance with the invention preferably contains virtually no constituents with a melting point above 70° C. and, more preferably, above 60° C. If the temperature in the cleaning solution falls below this melting temperature, high-melting alkanes in the paraffin can leave unwanted wax residues behind on the surfaces to be cleaned or the ware to be cleaned. Wax residues such as these generally leave the cleaned surface with an unattractive appearance and should therefore be avoided.

Preferred detergent tablets contain at least one paraffin wax with a melting range of 50° C. to 60° C. as meltable or softenable substance in the cell walls, preferred processes being characterized in that the cell walls contain a paraffin wax with a melting range of 50 to 55° C.

The paraffin wax used preferably has a high content of alkanes, isoalkanes and cycloalkanes solid at ambient temperature (generally about 10 to about 30° C.). The higher the percentage of solid wax constituents present in a wax at room temperature, the more useful that wax is for the purposes of the present invention. The higher the percentage of solid wax constituents, the greater the resistance of the detergent tablets according to the invention to impact or friction with other surfaces, which leads to longer lasting protection. Large percentages of oils or liquid wax constituents can weaken the particles or parts thereof so that pores are opened and the macroscopic structure collapses.

Besides paraffin as principal constituent, the meltable or softenable substances may also contain one or more of the waxes or wax-like substances mentioned above. In another preferred embodiment of the present invention, the composition of the mixture forming the meltable or softenable substances should be such that the foamable composition and the tablet or tablet phase formed therefrom are at least substantially insoluble in water. Their solubility in water should not exceed about 10 mg/l at a temperature of about 30° C. and should preferably be below 5 mg/l.

In such cases, however, the meltable or softenable substances should have very low solubility in water, even in water at elevated temperature, in order largely to avoid the active substances being released independently of temperature.

The principle described above facilitates the delayed release of ingredients at a certain time in the wash cycle of a dishwasher and may be applied with particular advantage when the main wash cycle is carried out at a relatively low temperature (for example 55° C.), so that the active substance is only released from the rinse agent particles in the final rinse cycle at relatively high temperatures (ca. 70° C.).

Preferred tablets according to the invention are characterized in that they contain one or more substances with a melting range of 40° C. to 75° C. as meltable or softenable substances in quantities of 6 to 30% by weight, preferably in quantities of 7.5 to 25% by weight and more preferably in quantities of 10 to 20% by weight, based on the weight of the composition.

The tablets or tablet phases according to the invention may contain one or more fatty compounds as matrix material for the cell walls, preferred cell walls being characterized in that they contain 12.5 to 85, preferably 15 to 80, more preferably 17.5 to 75 and most preferably 20 to 70% by weight of fatty compounds.

Fatty compounds in the context of the present invention are substances liquid or solid at normal temperature (20° C.) which belong to the group of fatty alcohols, fatty acids and fatty acid derivatives, particularly fatty acid esters. Reaction products of fatty alcohols with alkylene oxides and the salts of fatty acids are regarded as surfactants in the context of the present invention and are not fatty compounds in that context. According to the invention, preferred fatty compounds are fatty alcohols and fatty alcohol mixtures, fatty acids and fatty acid mixtures, fatty acid esters with alkanols or diols or polyols, fatty acid amides, fatty amines, etc.

Preferred detergent tablets or tablet phases contain one or more substances from the groups of fatty alcohols, fatty acids and fatty acid esters as matrix material in the cell walls.

The fatty alcohols used are selected, for example, from the alcohols obtainable from native fats and oils 1-hexanol (caproic alcohol), 1-heptanol (oenanthic alcohol), 1-octanol (caprylic alcohol), 1-nonanol (pelargonic alcohol), 1-decanol (capric alcohol), 1-undecanol, 10-undecen-1-ol, 1-dodecanol (lauryl alcohol), 1-tridecanol, 1-tetradecanol (myristyl alcohol), 1-pentadecanol, 1-hexadecanol (cetyl alcohol), 1-heptadecanol, 1-octadecanol (stearyl alcohol), 9-cis-octadecen-1-ol (oleyl alcohol), 9-trans-octadecen-1-ol (erucyl alcohol), 9-cis-octadecen-1,12-diol (ricinolyl alcohol), all-cis-9,12,-octadecadien-1-ol (linoleyl alcohol), all-cis-9,12,15-octadecatrien-1-ol (linolenyl alcohol), 1-nonadecanol, 1-eicosanol (arachidyl alcohol), 9-cis-eicosen-1-ol (gadoleyl alcohol), 5,8,11,14-eicosatetraen-1-ol, 1-heneicosanol, 1-docosanol (behenyl alcohol), 13-cis-docosen-1-ol (erucyl alcohol), 13-trans-docosen-1-ol (brassidyl alcohol) and mixtures of these alcohols. According to the invention, Guerbet alcohols and oxo alcohols, for example $C_{13-15}$ oxo alcohols or mixtures of $C_{12-18}$ alcohols with $C_{12-14}$ alcohols may also readily be used as fatty compounds. However, alcohol mixtures, for example those such as the $C_{16-18}$ alcohols produced by Ziegler polymerization of ethylene, may of course also be used. Special examples of alcohols which may be used as component b) are the above-mentioned alcohols and also lauryl alcohol, palmityl alcohol and stearyl alcohol and mixtures thereof.

Particularly preferred detergent/cleaning tablets according to the invention contain one or more $C_{10-30}$ fatty alcohols, preferably $C_{12-24}$ fatty alcohols and more preferably 1-hexadecanol, 1-octadecanol, 9-cis-octadecen-1-ol, all-cis-9,12-octadecadien-1-ol, all-cis-9,12,15-octadecatrien-1-ol, 1-docosanol and mixtures thereof as matrix material in the cell walls.

Fatty acids may also be used as a matrix material for the cell walls. On an industrial scale, fatty acids are largely obtained from native fats and oils by hydrolysis. Whereas alkaline saponification, which was practised as long ago as the last century, led directly to the alkali metal salts (soaps), only water is now industrially used for hydrolysis, splitting the fats into glycerol and the free fatty acids. Industrially used processes include, for example, hydrolysis in an autoclave and continuous high-pressure hydrolysis. According to the invention, carboxylic acids suitable for use as fatty compounds are, for example, hexanoic acid (caproic acid), heptanoic acid (oenanthic acid), octanoic acid (caprylic acid), nonanoic acid (pelargonic acid), decanoic acid (capric acid), undecanoic acid, etc. According to the invention, it is preferred to use fatty acids, such as dodecanoic acid (lauric acid), tetradecanoic acid (myristic acid), hexa-decanoic acid (palmitic acid), octadecanoic acid (stearic acid), eicosanoic acid (arachic acid), docosanoic acid (behenic acid), tetracosanoic acid (lignoceric acid), hexacosanoic acid (cerotic acid), triacontanoic acid (melissic acid) and the unsaturated species 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octa-decadienoic acid (linolaidic acid) and 9c,12c,15c-octadecatrienoic acid (linolenic acid). Tridecanoic acid, pentadecanoic acid, margaric acid, nonadecanoic acid, erucic acid, elaeostearic acid and arachidonic acid may also be used. For reasons of cost, technical mixtures of the individual acids obtainable from the hydrolysis of fats are used in preference to the pure species. Mixtures such as these are, for example, coconut oil fatty acid (ca. 6% by weight $C_8$, 6% by weight $C_{10}$, 48% by weight $C_{12}$, 18% by weight $C_{14}$, 10% by weight $C_{16}$, 2% by weight $C_{18}$, 8% by weight $C_{18'}$, 1% by weight $C_{18''}$), palm kernel oil fatty acid (ca. 4% by weight $C_8$, 5% by weight $C_{10}$, 50% by weight $C_{12}$, 15% by weight $C_{14}$, 7% by weight $C_{16}$, 2% by weight $C_{18}$, 15% by weight $C_{18'}$, 1% by weight $C_{18''}$), tallow fatty acid (ca. 3% by weight $C_{14}$, 26% by weight $C_{16}$, 2% by weight $C_{16'}$, 2% by weight $C_{17}$, 17% by weight $C_{18}$, 44% by weight $C_{18'}$, 3% by weight $C_{8''}$, 1% by weight $C_{18'''}$), hydrogenated tallow fatty acid (ca. 2% by weight $C_{14}$, 28% by weight $C_{16}$, 2% by weight $C_{17}$, 63% by weight $C_{18}$, 1% by weight $C_{18'}$), technical oleic acid (ca. 1% by weight $C_{12}$, 3% by weight $C_{14}$, 5% by weight $C_{16}$, 6% by weight $C_{16'}$, 1% by weight $C_{17}$, 2% by weight $C_{18}$, 70% by weight $C_{18'}$, 10% by weight $C_{18''}$, 0.5% by weight $C_{18'''}$), technical palmitic/stearic acid (ca. 1% by weight $C_{12}$, 2% by weight $C_{14}$, 45% by weight $C_{16}$, 2% by weight $C_{17}$, 47% by weight $C_{18}$. 1% by weight $C_{18'}$) and soybean oil fatty acid (ca. 2% by weight $C_{14}$, 15% by weight $C_{16}$, 5% by weight $C_{18}$, 25% by weight $C_{18'}$, 45% by weight $C_{18''}$, 7% by weight $C_{18'''}$).

The fatty acid esters used may be the esters of fatty acids with alkanols, diols or polyols, fatty acid polyol esters being preferred. Suitable fatty acid polyol esters are mono- or diesters of fatty acids with certain polyols. The fatty acids esterified with the polyols are preferably saturated or unsaturated fatty acids containing 12 to 18 carbon atoms, for example lauric acid, myristic acid, palmitic acid or stearic acid, technical mixtures of the fatty acids, for example the acid mixtures derived from coconut oil, palm kernel oil or tallow, preferably being used. Acids or mixtures of acids containing 16 to 18 carbon atoms, for example tallow fatty acid, are particularly suitable for esterification with the polyhydric alcohols. According to the invention, suitable polyols which are esterified with the fatty acids mentioned above are sorbitol, trimethylol propane, neopentyl glycol, ethylene glycol, polyethylene glycols, glycerol and polyglycerols.

In preferred embodiments of the invention, glycerol is used as the polyol esterified with fatty acid(s). Accordingly, preferred detergent tablets according to the invention are characterized in that the matrix material for the cell walls contains one or more fatty compounds from the group of fatty alcohols and fatty acid glycerides. Particularly preferred detergent tablets contain a fatty compound from the group of fatty alcohols and fatty acid monoglycerides in the cell walls. Examples of such preferred fatty compounds are glycerol monostearic acid ester and glycerol monopalmitic acid ester.

According to the invention, preferred detergent/cleaning tablets are characterized in that the solid partitions contain one or more substances having a melting point above 50°, preferably from the group of paraffins, polyethylene glycols and fatty compounds.

Other preferred materials for the cell walls of the detergent/cleaning tablets or tablet phases according to the invention are, in particular, polymers. The polymers may be used either individually or in admixture with other ingredients (i.e. as matrix material). Generally speaking, fully water-soluble polymers are preferred in view of the application envisaged for the tablets according to the invention (cf. the foregoing observations).

Biopolymers, such as gelatine, starch, pectin, alginates, etc. may also be used as materials for the solid cell walls.

Gelatine is a polypeptide (molecular weight ca. 15,000->250,000 g/mole) which is mainly obtained by hydrolysis of the collagen present in the skin and bones of animals under acidic or alkaline conditions. The amino acid composition of gelatine largely corresponds to that of the collagen from which it was obtained and varies according to its provenance. The use of gelatine as a water-soluble capsule material is particularly widespread in pharmacy (hard or soft gelatine capsules). Gelatine is rarely used in the form of films on account of its high price compared with the polymers mentioned above.

According to the invention, detergent tablets of which the cell walls (or parts thereof) consist of at least one polymer from the group of starch and starch derivatives, cellulose and cellulose derivatives, more particularly methyl cellulose and mixtures thereof are also preferred.

Starch is a homoglycan in which the glucose units are attached by a-glycoside bonds. Starch is made up of two components of different molecular weight, namely ca. 20-30% straight-chain amylase (molecular weight ca. 50,000 to 150,000) and 70-80% of branched-chain amyl pectin (molecular weight ca. 300,000 to 2,000,000). Small quantities of lipids, phosphoric acid and captions are also present. Whereas the amylase—on account of the bond in the 1,4-position—forms long, helical interdicted chains containing about 300 to 1,200 glucose molecules, the amyl pectin chain branches through a 1,6-bond after—on average—25 glucose units to form a branch-like structure containing about 1,500 to 12,000 glucose molecules. Besides pure starch, starch derivatives obtainable from starch by polymer-analog reactions may also be used as film materials for the purposes of the invention. Such chemically modified starches include, for example, products of esterification or etherification reactions in which hydroxy hydrogen atoms were substituted. However, starches in which the hydroxy groups have been replaced by functional groups that are not attached by an oxygen atom may also be used as starch derivatives. The group of starch derivatives includes, for example, alkali metal starches, carboxymethyl starch (CMS), starch esters and ethers and amino starches.

Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5000 glucose units and, accordingly, have average molecular weights of 50,000 to 500,000. According to the invention, cellulose derivatives obtainable from cellulose by polymer-analog reactions may also be used as cellulose-based disintegration aids. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses.

The tablets according to the invention can be made in certain shapes and certain sizes. Suitable shapes are virtually any easy-to-handle shapes, for example slabs, bars, cubes, squares and corresponding shapes with flat sides and, in particular, cylindrical forms of circular or oval cross-section. This last embodiment encompasses shapes from tablets to compact cylinders with a height-to-diameter ratio of more than 1.

The tablets according to the invention may be formed as separate individual elements which correspond to a predetermined dose of the detergent. However, it is also possible to form tablets which combine several such units in a single tablet, smaller portioned units being easy to break off in particular through the provision of predetermined weak spots. For the use of laundry detergents in machines of the standard European type with horizontally arranged mechanics, it can be of advantage to produce the portioned pressings as cylindrical or square tablets, preferably with a diameter-to-height ratio of about 0.5:2 to 2:0.5.

The three-dimensional form of another embodiment of the tablets according to the invention is adapted in its dimensions to the dispensing compartment of commercially available domestic washing machines, so that the tablets can be introduced directly, i.e. without a dosing aid, into the dispensing compartment where they dissolve on contact with water. However, it is of course readily possible—and preferred in accordance with the present invention—to use the detergent tablets in conjunction with a dosing aid.

Another preferred tablet which can be produced has a plate-like or slab-like structure with alternately thick long segments and thin short segments, so that individual segments can be broken off from this "bar" at the predetermined weak spots, which the short thin segments represent, and introduced into the machine. This "bar" principle can also be embodied in other geometric forms, for example vertical triangles which are only joined to one another at one of their longitudinal sides.

In another possible embodiment, however, the various components are not compressed to form a single tablet, instead the tablets obtained comprise several layers, i.e. at least two layers. These various layers may have different dissolving rates. This can provide the tablets with favorable performance properties. If, for example, the tablets contain components which adversely affect one another, one component may be integrated in the more quickly dissolving layer while the other component may be incorporated in a more slowly dissolving layer so that the first component can already have reacted off by the time the second component dissolves. The various layers of the tablets can be arranged in the form of a stack, in which case the inner layer(s) dissolve at the edges of the tablet before the outer layers have completely dissolved. Alternatively, however, the inner layer(s) may also be completely surrounded by the layers lying further to the outside which prevents constituents of the inner layer(s) from dissolving prematurely.

In another preferred embodiment of the invention, a tablet consists of at least three layers, i.e. two outer layers and at least one inner layer, a peroxy bleaching agent being present in at least one of the inner layers whereas, in the case of the stack-like tablet, the two cover layers and, in the case of the envelope-like tablet, the outermost layers are free from peroxy bleaching agent. In another possible embodiment, peroxy bleaching agent and any bleach activators or bleach catalysts present and/or enzymes may be spatially separated from one another in one and the same tablet. Multilayer tablets such as these have the advantage that they can be used not only via a dispensing compartment or via a dosing unit which is added to the wash liquor, instead it is also possible in cases such as these to introduce the tablet into the machine in direct contact with the fabrics without any danger of spotting by bleaching agent or the like.

Similar effects can also be obtained by coating individual constituents of the detergent composition to be compressed or the tablet as a whole. To this end, the tablets to be coated may be sprayed, for example, with aqueous solutions or emulsions or a coating may be obtained by the process known as melt coating.

Besides by their shape and a multilayer structure, the tablets according to the invention may also be visually differentiated by incorporation of colored particles, so-called specks. For example, a white tablet may be homogeneously colored with colored, for example blue, red, green, yellow, etc., specks. In order to achieve uniform distribution of the colored specks throughout the tablet and hence to obtain a visually attractive tablet, the quantity of colored specks and their particle size should be adapted to the rest of the premix forming the tablet matrix from which the specks visually stand out. For example, if a tablet mixture has a particle spectrum of 200 to 1800 μm, specks in the same or a larger particle size range will only be uniformly distributed above a threshold value of ≧6% by weight, based on the tablet mixture. Smaller quantities would then lead to a visually unattractive accumulation of particles in certain parts of the tablet while other parts would remain almost speck-free. In order to obtain a uniform impression even with relatively low concentrations of colored particles, it is advisable to reduce the particle size of the colored speck particles. Thus, in the above example of a tablet mixture in the particle size range of 200 to 1,800 μm, uniform distribution of the specks is achieved with only 2 to 3% by weight of colored specks where they have particle sizes in the 200 to 800 μm range.

A multilayer structure of the tablets can be also be visualized by uniform "speckling" which can be achieved as described above by adapting the particle size and quantity of colored specks to the premix. It is possible in this way to produce tablets with two or more layers of which one is non-colored while a second layer is visually emphasized by specks. This concept can also be applied, for example, to three-layer tablets in which one layer is non-colored, the second is "color-speckled" and the third is colored throughout. Besides the coloring of layers, cores, for example, or other parts of core/jacket tablets, ring/core tablets or bull's eye tablets may also be colored or "speckled". The expert is virtually unlimited in the range of variation of these possibilities for achieving visual differentiation.

In the case of multiphase tablets, preferred detergent/cleaning tablets according to the invention are characterized in that the phases assume the form of layers.

Besides the "traditional" layer structure, various other forms can be achieved in accordance with the invention which is an advantage of the present invention. For example, other preferred detergent/cleaning tablets according to the invention are characterized in that at least one phase has a cavity in which another phase is at least partly embedded.

The cavity in the tablets may assume any shape. It may extend throughout the tablet, i.e. may have an opening at the top and bottom of the tablet, although it may also be a cavity which does not extend throughout the tablet, i.e. a cavity of which the opening is only visible on one side of the tablet.

The tablets according to the invention may assume any geometric form, concave, convex, biconcave, biconvex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral forms being particularly preferred. Completely irregular bases, such as arrow and animal shapes, trees, clouds etc. can also be produced. If the tablets according to the invention have corners and edges, they are preferably rounded off. As an additional optical differentiation, an embodiment with rounded-off corners and bevelled ("chamfered") edges is preferred.

The shape of the cavity can also be freely selected. In the interests of process economy, holes which open on opposite sides of the tablets and recesses which open on one side only have proved successful. In preferred detergent tablets, the cavity is in the form of a hole opening on two opposite sides of the tablet. The shape of this hole may be freely selected, preferred tablets being characterized in that the hole has circular, ellipsoidal, triangular, rectangular, square, pentagonal, hexagonal, heptagonal or octagonal horizontal sections. The hole may also assume completely irregular shapes, such as arrow or animal shapes, trees, clouds, etc. As with the tablets, angular holes preferably have rounded-off corners and edges or rounded-off corners and chamfered edges.

The geometric forms mentioned above may be combined as required with one another. Thus, tablets with a rectangular or square base and circular holes can be produced just as well as round tablets with octagonal holes, the various combination possibilities being unlimited. In the interests of process economy and consumer acceptance, particularly preferred holed tablets are characterized in that the base of the tablet and the cross-section of the hole have the same geometric form, for example tablets with a square base and a centrally located square hole. Ring tablets, i.e. circular tablets with a circular hole, are particularly preferred.

If the above-mentioned principle of the hole open on two opposite sides of the tablet is reduced to one opening, the result is a recess tablet. Detergent tablets according to the invention in which the cavity assumes the form of a recess are also preferred. As with the "hole tablets", the tablets according to the invention in this embodiment, too, may assume any geometric form, concave, convex, biconcave, biconvex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and octagonal-prismatic and rhombohedral forms being particularly preferred. The base of the tablet may even assume a completely irregular shape, such as arrow or animal shapes, trees, clouds, etc. If the tablet has corners and edges, they are preferably rounded-off. As an additional optical differentiation, an embodiment with rounded-off corners and chamfered ("bevelled") edges is preferred.

The shape of the recess may also be freely selected, tablets in which at least one recess may assume a concave, convex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral form being preferred. The recess may also assume a totally irregular shape, such as arrow or animal shapes, trees, clouds etc. As with the tablets, recesses with rounded-off corners and edges or with rounded-off corners and chamfered edges are preferred.

The shape of the recess may also be freely selected, tablets in which at least one recess may assume a concave, convex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral form being preferred. The recess may also assume a totally irregular shape, such as arrow or animal shapes, trees, clouds etc. As with the tablets, recesses with rounded-off corners and edges or with rounded-off corners and chamfered edges are preferred.

The size of the recess or the hole by comparison with the tablet as a whole is governed by the application envisaged for the tablets. The size of the cavity can vary according to whether it is to be filled with another tablet phase and whether a relatively small or relatively large quantity of other phase is intended to be present. Irrespective of the intended application, preferred detergent tablets are characterized in that the ratio by volume of tablet to cavity is 2:1 to 100:1, preferably 3:1 to 80:1, more preferably 4:1 to 50:1 and most preferably 5:1 to 30:1.

Similar observations may also be made on the contribution which the tablet with the cavity ("basic tablet") or the opening area of the cavity makes to the total surface area of the tablet. Here, preferred detergent tablets are characterized in that the area of the opening(s) of the cavity(ies) makes up 1 to 25%, preferably 2 to 20%, more preferably 3 to 15% and most preferably 4 to 10% of the total surface area of the tablet.

In the case of multiphase cavity tablets, any of the various possibilities may be realized in accordance with the invention. In other words, it is possible in accordance with the invention to produce two-phase tablets in which the phase with the cavity consists of gas-filled cells (pores) delimited by solid partitions while the filling of the other cavity is achieved by another production technology. In addition, exactly the opposite case is possible, i.e. a tablet where the phase with the cavity was produced by compression, casting, sintering, etc. and the filling of the cavity consists of gas-filled cells (pores) which are delimited by solid partitions. Last but not least, it is of course also possible to produce tablets according to the invention where both the phase with the cavity and the filling of the cavity consist of gas-filled cells (pores) delimited by solid partitions.

According to the invention, it is also possible to produce tablets where the phase consisting of gas-filled cells (pores) delimited by solid partitions acts as a kind of "matrix" in which the particles forming the other phase are suspended. In this case, it is visually particularly attractive if the embedded particles are several millimeters in size, for example between 1 and 10 mm, preferably between 2 and 7 mm and more particularly between 2.5 and 5 mm in size. According to the invention, detergent/cleaning tablets in which one phase consists of gas-filled cells surrounded by solid partitions in which the other phase(s) are embedded are preferred.

Particularly preferred detergent tablets are characterized in that the phase embedded in the phase consisting of gas-filled cells surrounded by solid partitions consists of particulate solids.

In the case of multiphase tablets, a tablet phase according to the invention can be combined with other "non-invention" tablet phases produced by conventional technologies. For example, preferred detergent/cleaning tablets according to the invention are characterized in that the non-foamed phase is a compressed portion.

However, other preferred detergent/cleaning tablets according to the invention are characterized in that the non-foamed layer is a non-compressed portion. Of these tablets, those where the non-foamed layer is a sintered portion are particularly preferred while those where the non-foamed layer is a cast portion are even more preferred.

Whatever the combination of phase according to the invention and "non-invention" phase, generally preferred detergent/cleaning tablets are characterized in that the ratio by weight between foamed and non-foamed phase is in the range from 30:1 to 1:50, preferably in the range from 5:1 to 1:30 and more preferably in the range from 1:1 to 1:10.

Analogously, detergent/cleaning tablets according to the invention where the ratio by volume between foamed and non-foamed phase is in the range from 50:1 to 1:20, preferably in the range from 10:1 to 1:10, more preferably in the range from 5:1 to 1:5 and most preferably in the range from 4:1 to 1:2.

Depending on the choice of active ingredients, the controlled release of active ingredients from multiphase tablets can be achieved by controlling the dissolving rate of individual phases. Here, preferred detergent/cleaning tablets according to the invention are characterized in that the foamed phase(s) dissolve(s) more quickly than the non-foamed phase(s).

In a particularly preferred embodiment, at least 50% by weight of the foamed phase(s) is dissolved when at most 10% by weight of the non-foamed phase(s) is dissolved.

Alternatively, the foamed phase can also be retarded in its dissolution. Preferred detergent/cleaning tablets according to the invention are characterized in that the foamed phase(s) dissolve(s) more slowly than the non-foamed phase(s), particularly preferred detergent/cleaning tablets being characterized in that at least 50% of the non-foamed phase(s) is dissolved when at most 10% by weight of the foamed phase(s) is dissolved.

Further particulars of the physical parameters of the detergent/cleaning tablets according to the invention and details of their production can be found hereinafter. The preferred ingredients of the tablets which may be present both in the foamed phase and in optionally non-foamed phases will now be described.

The detergent/cleaning tablets according to the invention may contain any of the builders typically used in detergents/cleaners, i.e. in particular zeolites, silicates, carbonates, organic co-builders and—providing there are no ecological objections to their use—even the phosphates. Generally speaking, preferred detergent/cleaning tablets contain builders in quantities of 1 to 95% by weight, preferably 5 to 90% by weight, more preferably 10 to 85% by weight and most preferably 20 to 75% by weight, based in each case on the weight of the tablet as a whole.

The builders are described in detail in the foregoing.

According to the invention, preferred detergent tablets are characterized in that they contain silicate(s), preferably alkali metal silicates and more preferably crystalline or amorphous alkali metal disilicates in quantities of 10 to 60% by weight, preferably in quantities of 15 to 50% by weight and more preferably in quantities of 20 to 40% by weight, based on the weight of the basic tablet. Other preferred detergent tablets according to the invention are characterized in that they contain phosphate(s), preferably alkali metal phosphate(s) and more preferably pentasodium or pentapotassium triphosphate (sodium or potassium tripolyphosphate) in quantities of 20 to 80% by weight, preferably in quantities of 25 to 75% by weight and more preferably in quantities of 30 to 70% by weight, based on the weight of the tablet as a whole.

Alkalinity sources may be present as further constituents. Alkalinity sources are, for example, alkali metal hydroxides, alkali metal carbonates, alkali metal hydrogen carbonates, alkali metal sesquicarbonates, the alkali metal silicates mentioned, alkali metal metasilicates and mixtures thereof. According to the present invention, preferred alkalinity sources are the alkali metal carbonates, more particularly sodium carbonate, sodium hydrogen carbonate and sodium sesquicarbonate. A builder system containing a mixture of tripolyphosphate and sodium carbonate is particularly preferred, as is a builder system containing a mixture of tripolyphosphate and sodium carbonate and sodium disilicate. Particularly preferred detergent tablets contain carbonate(s) and/or hydrogen carbonate(s), preferably alkali metal carbonates and more preferably sodium carbonate, in quantities of 5 to 50% by weight, preferably in quantities of 7.5 to 40% by weight and more preferably in quantities of 10 to 30% by weight, based on the weight of the basic tablet.

Preferred detergent tablets additionally contain one or more surfactant(s). Anionic, nonionic, cationic and/or amphoteric surfactants or mixtures thereof may be used in the detergent tablets according to the invention. From the performance perspective, mixtures of anionic and nonionic surfactants are preferred for laundry detergent tablets while nonionic surfactants are preferred for dishwasher tablets. The total surfactant content of laundry detergent tablets is between 5 and 60% by weight and preferably above 15% by weight, based on tablet weight, whereas dishwasher detergent tablets preferably contain less than 5% by weight of surfactant(s). The surfactants were also described in detail in the foregoing.

According to the invention, preferred laundry detergent tablets are those containing anionic and nonionic surfactant(s). Performance-related advantages can arise out of certain quantity ratios in which the individual classes of surfactants are used.

For example, particularly preferred detergent tablets are characterized in that the ratio of anionic surfactant(s) to nonionic surfactant(s) is from 10:1 to 1 :10, preferably from 7.5:1 to 1:5 and more preferably from 5:1 to 1:2. Other preferred detergent tablets contain surfactant(s), preferably anionic and/or nonionic surfactant(s), in quantities of 5 to 40% by weight, preferably 7.5 to 35% by weight, more preferably 10 to 30% by weight and most preferably 12.5 to 25% by weight, based on the weight of the tablet.

It can be of advantage from the performance point of view if certain classes of surfactants are missing from certain phases of the detergent tablets or from the entire tablet, i.e. from every phase. In another important embodiment of the present invention, therefore, at least one phase of the tablets is free from nonionic surfactants.

Conversely, a positive effect can also be obtained through the presence of certain surfactants in individual phases or in the tablet as a whole, i.e. in every phase. Introducing the alkyl polyglycosides described above has proved to be of particular advantage, so that detergent tablets in which at least one phase of the tablet contains alkyl polyglycosides are preferred.

As with the nonionic surfactants, the omission of anionic surfactants from individual phases or from all phases can result in detergent tablets which are more suitable for certain applications. Accordingly, detergent tablets where at least one phase of the tablet is free from anionic surfactants are also possible in accordance with the present invention.

In the case of dishwasher tablets, preferred tablets according to the invention have total surfactant contents below 5% by weight, preferably below 4% by weight, more preferably below 3% by weight and, in a most particularly preferred embodiment, below 2% by weight, based on the weight of the tablet as a whole.

Conversely, preferred laundry detergent tablets according to the invention contain anionic and/or nonionic surfactant(s) and have total surfactant contents above 5% by weight, preferably above 10% by weight and more particularly above 15% by weight, based on the weight of the tablet.

As already mentioned, the use of surfactants in dishwasher tablets is preferably confined to the use of nonionic surfactants in small quantities. Detergent tablets preferably used as dishwasher tablets in accordance with the invention are characterized in that the tablet has total surfactant contents below 5% by weight, preferably below 4% by weight, more preferably below 3% by weight and most preferably below 2% by weight, based on the weight of the basic tablet. Normally, the only surfactants used in dishwasher detergents are low-foaming nonionic surfactants. Representatives from the groups of anionic, cationic or amphoteric surfactants are of lesser importance. In one particularly preferred embodiment, the dishwasher detergent tablets according to the invention contain nonionic surfactants, more particularly nonionic surfactants from the group of alkoxylated alcohols. These were described in detail in the foregoing.

In order to facilitate the disintegration of tablets, disintegration aids, so-called tablet disintegrators, may be incorporated in the basic tablets to shorten their disintegration times. Tablet disintegrators or disintegration accelerators are auxiliaries which promote the rapid disintegration of tablets in water or gastric juices and the release of the pharmaceuticals in an absorbable form.

These substances, which are also known as "disintegrators" by virtue of their effect, are capable of undergoing an increase in volume on contact with water so that, on the one hand, their own volume is increased (swelling) and, on the other hand, a pressure can be generated through the release of gases which causes the tablet to disintegrate into relatively small particles. Well-known disintegrators are, for example, carbonate/citric acid systems, although other organic acids may also be used. Swelling disintegration aids are, for example, synthetic polymers, such as polyvinyl pyrrolidone (PVP), or natural polymers and modified natural substances, such as cellulose and starch and derivatives thereof, alginates or casein derivatives.

Preferred detergent tablets contain 0.5 to 10% by weight, preferably 3 to 7% by weight and more preferably 4 to 6% by weight of one or more disintegration aids, based on the weight of the tablet. If only the basic tablet contains disintegration aids, the figures mentioned are based solely on the weight of the basic tablet.

According to the invention, preferred disintegrators are cellulose-based disintegrators, so that preferred detergent tablets contain a cellulose-based disintegrator in quantities of 0.5 to 10% by weight, preferably 3 to 7% by weight and more preferably 4 to 6% by weight. Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5,000 glucose units and, accordingly, have average molecular weights of 50,000 to 500,000. According to the invention, cellulose derivatives obtainable from cellulose by polymer-analog reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses. The cellulose derivatives mentioned are preferably not used on their own, but rather in the form of a mixture with cellulose as cellulose-based disintegrators. The content of cellulose derivatives in mixtures such as these is preferably below 50% by weight and more preferably below 20% by weight, based on the cellulose-based disintegrator. In one particularly preferred embodiment, pure cellulose free from cellulose derivatives is used as the cellulose-based disintegrator.

The cellulose used as disintegration aid is preferably not used in fine-particle form, but is converted into a coarser form, for example by granulation or compacting, before it is added to and mixed with the premixes to be tabletted. Detergent tablets which contain granular or optionally co-granulated disintegrators are described in German patent applications DE 197 09 991 (Stefan Herzog) and DE 197 10 254 (Henkel) and in International patent application particulars of the production of granulated, compacted or co-granulated cellulose disintegrators can also be found in these patent applications. The particle sizes of such disintegration aids is mostly above 200 μm, preferably at least 90% by weight of the particles being between 300 and 1600 μm in size and, more particularly, between 400 and 1200 μm in size. According to the invention, the above-described relatively coarse-particle cellulose-based disintegrators described in detail in the cited patent applications are preferably used as disintegration aids and are commercially obtainable, for example under the name of Arbocel® TF-30-HG from Rettenmaier.

Microcrystalline cellulose may be used as another cellulose-based disintegration aid or as part of such a component. This microcrystalline cellulose is obtained by partial hydrolysis of the celluloses under conditions which only attack and completely dissolve the amorphous regions (ca. 30% of the total cellulose mass) of the celluloses, but leave the crystalline regions (ca. 70%) undamaged. Subsequent de-aggregation of the microfine celluloses formed by hydrolysis provides the microcrystalline celluloses which have primary particle sizes of ca. 5 μm and which can be compacted, for example, to granules with a mean particle size of 200 μm.

According to the invention, preferred detergent tablets additionally contain a disintegration aid, preferably a cellulose-based disintegration aid, preferably in granular, co-granulated or compacted form, in quantities of 0.5 to 10% by weight, preferably in quantities of 3 to 7% by weight and more preferably in quantities of 4 to 6% by weight, based on tablet weight.

The detergent tablets according to the invention may additionally contain a gas-evolving effervescent system both in the basic tablet and in the cavity. The gas-evolving effervescent system may consist of a single substance which releases a gas on contact with water. Among these compounds, particular mention is made of magnesium peroxide which releases oxygen on contact with water. However, the gas-releasing effervescent system normally consists of at least two constituents which react with one another to form a gas. Although various possible systems could be used, for example systems releasing nitrogen, oxygen or hydrogen, the effervescent system used in the detergent tablets according to the invention should be selected with both economic and ecological considerations in mind. Preferred effervescent systems consist of alkali metal carbonate and/or hydrogen carbonate and an acidifying agent which is capable of releasing carbon dioxide from the alkali metal salts in aqueous solution.

Among the alkali metal carbonates and hydrogen carbonates, the sodium and potassium salts are preferred to the other salts for reasons of cost. The pure alkali metal carbonates and hydrogen carbonates do not of course have to be used, instead mixtures of different carbonates and hydrogen carbonates may be preferred.

In preferred detergent tablets, 2 to 20% by weight, preferably 3 to 15% by weight and more preferably 5 to 10% by weight of an alkali metal carbonate or hydrogen carbonate and 1 to 15% by weight, preferably 2 to 12% by weight and more preferably 3 to 10% by weight of an acidifying agent, based on the tablet as a whole, are used as the effervescent system.

Suitable acidifying agents which release carbon dioxide from the alkali metal salts in aqueous solution are, for example, boric acid and alkali metal hydrogen sulfates, alkali metal dihydrogen phosphates and other inorganic salts. However, organic acidifying agents are preferably used, citric acid being a particularly preferred acidifying agent. However, other solid mono-, oligo- and polycarboxylic acids in particular may also be used. Within this group, tartaric acid, succinic acid, malonic acid, adipic acid, maleic acid, fumaric acid, oxalic acid and polyacrylic acid are preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially obtainable and may also be used with advantage as an acidifying agent for the purposes of the present invention.

According to the invention, preferred detergent tablets are those in which a substance selected from the group of organic di-, tri- and oligocarboxylic acids or mixtures thereof is present as the acidifying agent in the effervescent system.

Bleaching agents and bleach activators which are important ingredients of detergent/cleaners are described in the foregoing. Detergent/cleaning tablets which are characterized in that they contain bleaching agents from the group of oxygen or halogen bleaching agents, more particularly chlorine bleaching agents and preferably sodium perborate and sodium percarbonate, in quantities of 2 to 25% by weight, preferably 5 to 20% by weight and more particularly 10 to 15% by weight, based on the weight of the tablet, represent a preferred embodiment of the invention. In another preferred embodiment, the tablets according to the invention contain bleach activators. Detergent tablets containing bleach activators from the groups of polyacylated alkylenediamines, more particularly tetraacetyl ethylenediamine (TAED), N-acylimides, more particularly N-nonanoyl succinimide (NOSI), acylated phenol sulfonates, more particularly n-nonanoyl- or isononanoyl-oxybenzenesulfonate (n- or iso-NOBS) and n-methyl morpholinium acetonitrile methyl sulfate (MMA) in quantities of 0.25 to 15% by weight, preferably 0.5 to 10% by weight and more particularly 1 to 8% by weight, based on the weight of the tablet as a whole, represent other preferred embodiments of the invention.

The cleaning tablets according to the invention may contain, particularly in the foamed phase, corrosion inhibitors to protect the machine load and the machine. These corrosion inhibitors are described in the foregoing. According to the invention, preferred detergent/cleaning tablets contain silver protectors from the group of triazoles, benzotriazoles, bisbenzotriazoles, aminotriazoles, alkyl aminotriazoles and transition metal salts or complexes, preferably benzotriazole and/or alkyl aminotriazole, in quantities of 0.01 to 5% by weight, preferably 0.05 to 4% by weight and more preferably 0.5 to 3% by weight, based on the weight of the tablet.

Besides the ingredients mentioned above, other classes of substances are suitable for incorporation in detergents. Preferred detergent/cleaning tablets are characterized in that they additionally contain one or more substances from the groups of enzymes, corrosion inhibitors, scale inhibitors, co-builders, dyes and/or perfumes in total quantities of 6 to 30% by weight, preferably 7.5 to 25% by weight and more particularly 10 to 20% by weight, based on the weight of the tablet.

Besides the above-mentioned constituents (builders, surfactants, disintegration aids, bleaching agents and bleach activators), the detergent/cleaning tablets according to the invention may contain other typical detergent ingredients from the group of dyes, perfumes, optical brighteners, enzymes, foam inhibitors, silicone oils, redeposition inhibitors, discoloration inhibitors, dye transfer inhibitors and corrosion inhibitors. Enzymes, dyes and perfumes are described in detail in the foregoing.

The detergent tablets according to the invention may contain one or more optical brightener(s). These substances, which are also known as "whiteners", are used in modern detergents because even freshly washed and bleached white laundry has a slight yellowish tinge. Optical brighteners are organic dyes which convert part of the invisible UV radiation in sunlight into longer wave blue light. The emission of this blue light fills the "gap" in the light reflected by the fabric, so that a fabric treated with optical brightener appears whiter and brighter to the eye. Since the action mechanism of brighteners presupposes their absorption onto the fibers, brighteners are differentiated according to the fibers "to be colored", for example as brighteners for cotton, polyamide or polyester fibers. The commercially available brighteners suitable for incorporation in detergents largely belong to five structural groups, namely: the stilbene, the diphenyl stilbene, the coumarin/quinoline and the diphenyl pyrazoline group and the group where benzoxazole or benzimidazole is combined with conjugated systems. Conventional brighteners are reviewed, for example, in G. Jakobi, A. Löhr "Detergents and Textile Washing", VCH-Verlag, Weinheim, 1987, pages 94 to 100. Suitable brighteners are, for example, salts of 4,4'-bis-[(4-anilino-6-morpholino-s-triazin-2-yl)-amino]-stilbene-2,2'-disulfonic acid or compounds of similar structure which, instead of the morpholino group, contain a diethanolamino group, a methylamino group, an anilino group or a 2-methoxyethylamino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

In addition, the detergent tablets according to the invention may also contain components with a positive effect on the removal of oil and fats from textiles by washing (so-called soil repellents). This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Foam inhibitors suitable for use in the detergents according to the invention are, for example, soaps, paraffins and silicone oils which may optionally be applied to carrier materials.

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof are preferably used, for example in quantities of 0.1 to 5% by weight, based on the detergent.

Since sheet-form textiles, more particularly of rayon, rayon staple, cotton and blends thereof, can tend to crease because the individual fibers are sensitive to sagging, kinking, pressing and squeezing transversely of the fiber direction, the compositions according to the invention may contain synthetic anticrease agents, including for example synthetic products based on fatty acids, fatty acid esters, fatty acid amides, alkylol esters, alkylol amides or fatty alcohols, which are generally reacted with ethylene oxide, or products based on lecithin or modified phosphoric acid esters.

To control microorganisms, the compositions according to the invention may contain antimicrobial agents. According to the antimicrobial spectrum and the action mechanism, antimicrobial agents may be divided into bacteriostatic agents and bactericides, fungistatic agents and fungicides, etc. Important representatives of these groups are, for example, benzalkonium chlorides, alkylaryl sulfates, halophenols and phenol mercury acetate, although these compounds may also be absent altogether.

In order to prevent unwanted changes in the compositions and/or the fabrics treated with them attributable to the effects of oxygen and other oxidative processes, the compositions may contain antioxidants. This class of compounds includes, for example, substituted phenols, hydroquinones, pyrocatechols and aromatic amines and also organic sulfides, polysulfides, dithiocarbamates, phosphites and phosphonates.

Wearing comfort can be increased by the additional use of antistatic agents which are additionally incorporated in the detergents according to the invention. Antistatic agents increase surface conductivity and thus provide for the improved dissipation of any charges which have built up. External antistatic agents are generally substances containing at least one hydrophilic molecule ligand and form a more or less hygroscopic film on the surfaces. These generally interfacially active antistatic agents may be divided into nitrogen-containing antistatics (amines, amides, quaternary ammonium compounds), phosphorus-containing antistatics (phosphoric acid esters) and sulfur-containing antistatics (alkyl sulfonates, alkyl sulfates). The lauryl (or stearyl) dimethyl benzyl ammonium chlorides disclosed therein are suitable as antistatic agents for textiles and as detergent additives and additionally develop a conditioning effect.

In order to improve the water absorption capacity and rewettability of the treated textiles and to make them easier to iron, silicone derivatives, for example, may be used in the compositions according to the invention. Silicone derivatives additionally improve the rinsing out behavior of the compositions through their foam-inhibiting properties. Preferred silicone derivatives are, for example, polydialkyl and alkylaryl siloxanes where the alkyl groups contain 1 to 5 carbon atoms and are completely or partly fluorinated. Preferred silicones are polydimethyl siloxanes which may optionally be derivatized and, in that case, are aminofunctional or quaternized or contain Si—OH—, Si—H— and/or Si—Cl bonds. The preferred silicones have viscosities at 25° C. of 100 to 100,000 centistokes and may be used in quantities of 0.2 to 5% by weight, based on the detergent as a whole.

Finally, the compositions according to the invention may also contain. UV filters which are absorbed onto the treated textiles and which improve the light stability of the fibers. Compounds which have these desirable properties are, for example, the compounds acting by "radiationless" deactivation and derivatives of benzophenone with substituents in the 2 position and/or 4 position. Substituted benzotriazoles, 3-phenyl-substituted acrylates (cinnamic acid derivatives), optionally with cyano groups in the 2-position, salicylates, organic Ni complexes and natural substances, such as umbelliferone and the body's own urocanic acid.

In tablets according to the invention which consist of several phases, the ingredients may be allocated to the individual phases and thus separated from one another. If they have a foamed and a non-foamed portion, detergent tablets in which the foamed portion contains at least one active ingredient from the group of enzymes, surfactants, soil release polymers, disintegration aids, bleaching agents, bleach activators, bleach catalysts, silver protectors and mixtures thereof are preferred.

As already mentioned, multiphase tablets can be used for separating active ingredients. Separation is advantageous, particularly with certain combinations of active ingredients. The following observations are made in the interests of verbal separation for multiphase tablets of foamed and non-foamed phases, but also apply mutatis mutandis to tablets of several foamed phases.

Particularly preferred detergent tablets according to the invention are characterized in that the foamed portion or the non-foamed portion contains bleaching agents while the portion of the tablet contains bleach activators.

Detergent tablets in which the foamed portion or the non-foamed portion contains bleaching agents while the other portion of the tablet contains enzymes are also preferred embodiments of the invention, as are detergent tablets which are characterized in that the foamed portion or the non-foamed portion contains bleaching agents while the other portion of the tablet contains corrosion inhibitors.

Last but not least, other preferred embodiments of the invention are detergent tablets in which the foamed portion or the non-foamed portion contains bleaching agents while the other portion of the tablet contains surfactants, preferably nonionic surfactants and more preferably alkoxylated alcohols containing 10 to 24 carbon atoms and 1 to 5 alkylene oxide units and detergent tablets which are characterized in that the foamed portion and the non-foamed portion contain the same active ingredient in different quantities.

The present invention also relates to a process for the production of detergent tablets in which a melt containing at least one active substance is exposed to a gaseous medium at temperatures above 25° C. and foamed and is then left to solidify.

This embodiment of the present invention comprises the above-described melting of a meltable substance (also referred to above as the matrix material for the cell walls), which itself may be active substance, the optional addition of (more) active substance in solid or liquid form and exposure to one or more gaseous media to form a foam structure which is converted by cooling into a solid foam. The substances suitable as matrix materials and as optional active substances are described in detail in the foregoing.

The present invention also relates to a process for the production of detergent tablets in which a solution containing at least one active ingredient is exposed to a gaseous medium and foamed which results in the formation of shaped bodies consisting of gas-filled cells (pores) delimited by solid partitions.

In contrast to the process described above, a solution, not a melt, is used as the starting point. Suitable substances—particularly polymers—and suitable solvents are also described in detail in the foregoing.

If process variants starting with solutions are selected, processes according to the invention in which the formation of the solid partitions is effected or supported by evaporation of solvent are preferred.

The reactive formation of cell structures is also possible so that processes in which the formation of the solid partitions is effected or supported by reaction of solvent and gaseous medium represent other preferred embodiments of the invention.

The present invention also relates to a process for the production of multiphase tablets, comprising the steps of a) forming shaped bodies by methods known per se,
b) exposing a solution, suspension, emulsion or melt containing at least one active ingredient to a gaseous medium to form shaped bodies consisting of gas-filled cells (pores) delimited by solid partitions,
c) combining the shaped bodies produced in steps a) and b).

In these processes, the tablets according to the invention represent one phase of multiphase tablets. In preferred variants of this process, the production of the tablets in step a) is carried out by extrusion, pelleting, tabletting, sintering, casting, injection molding, thermoforming, extrusion or rolling. These processes and tablets obtained by them are known in the art.

The tablets according to the invention are preferably combined with the conventional tablets in step c) of the process according to the invention by fitting together and/or into one another, coupling agents optionally being applied to the contact surfaces between the parts.

The process according to the invention is not of course confined to two-phase tablets and may also be used to produce three-, four- and five-phase tablets and also tablets with an even greater number of phases. Accordingly, processes according to the invention which are characterized in that several non-foamed tablets are combined with one or more foamed tablets are also preferred.

Last but not least, a process for the production of multiphase tablets which is characterized by the steps of a) exposing a solution, suspension, emulsion or melt containing at least one active ingredient to a gaseous medium to form shaped bodies consisting of gas-filled cells (pores) delimited by solid partitions,
b) exposing another solution or melt containing at least one active ingredient to a gaseous medium to form shaped bodies consisting of gas-filled cells (pores) delimited by solid partitions and
c) combining the shaped bodies produced in steps a) and b)

is another preferred embodiment of the present invention.

As explained in detail in the foregoing, the ingredients of the multiphase tablets according to the invention are preferably not uniformly distributed throughout the tablet as a whole, but are largely or exclusively concentrated in certain phases. Accordingly, processes in which the composition of the shaped bodies produced in steps a) and b) is different represent particularly preferred embodiments of the present invention. In another particularly preferred embodiment, the shaped bodies produced in steps a) and b) contain different active substance(s).

The composition of the tablet phases may also be identical in order to be able to utilize controlled-release effects on the basis of the make-up of the tablet. Accordingly, processes in which the composition of the shaped bodies produced in steps a) and b) is identical can also be carried out in accordance with the invention.

This embodiment is particularly attractive when two (or more) shaped bodies according to the invention are combined to form a tablet with two (or more) phases consisting of gas-filled cells (pores) which are delimited by solid partitions and in which the particulate solids are distributed. With tablets such as these, particular optical effects are achieved through different pore sizes. Accordingly, processes in which the shaped bodies produced in steps a) and b) differ in their mean pore sizes are preferred.

The present invention also relates to a process for the production of multiphase tablets which is characterized by the steps of a) exposing a solution, suspension, emulsion or melt containing at least one active ingredient to a gaseous medium,
b) incorporating particulate solids in the foam formed in step a),
c) cooling and/or curing to form a shaped body matrix consisting of gas-filled cells (pores) which are delimited by solid partitions and in which the particulate solids are distributed.

Preferred processes are characterized in that the solids incorporated in step b) belong to the group consisting of granules, agglomerates, extrudates, compactates or pellets and have particle sizes of 400 to 3,000 μm, preferably 600 to 2,500 μm and more particularly 800 to 2,000 μm.

Alternatively, visually inconspicuous incorporation of the particles may be desirable so that the particles do not visibly stand out from the foam structure. Here, preferred processes are characterized in that the solids incorporated in step b) have particle sizes of 50 to 600 μm, preferably 100 to 500 μm and more particularly 200 to 400 μm.

The preferred detergent tablets according to the invention described in the foregoing of which the cell walls consist at least partly of water-soluble polymers can be produced by another process.

Accordingly, the present invention also relates to a process for the production of the preferred detergent tablets according to the invention in the form of solid foams. This process for the production of foams by exposing a solution, melt, emulsion or suspension containing at least one active ingredient to a gaseous medium and foaming is characterized in that the solution, melt, suspension or emulsion contains, based on its weight, a) 40 to 90% by weight of one or more water-soluble polymers,
b) 10 to 59.99% by weight of one or more substances from the group of builders, acidifying agents, chelating agents, scale-inhibiting polymers or nonionic surfactants,
c) 0 to 50% by weight of one or more auxiliaries and/or fillers and
d) 0.01 to 30% by weight of a foaming gas (blowing agent).

The ingredients a) to c) are described in detail in the foregoing. Any gases or gas mixtures may be used as ingredient d) for foaming. Examples of gases used in the art are nitrogen, oxygen, noble gases and noble gas mixtures such as, for example, helium, neon, argon and mixtures thereof, carbon dioxide, etc. For reasons of cost, air is preferably used as the foaming gas in accordance with the invention. If the components to be foamed are oxidation-resistant, the gaseous medium may even consist entirely or partly of ozone so that impurities destroyable by oxidation or discoloration in the media to be foamed are eliminated or germ infestation of these components can be prevented.

Readily volatile compounds may also be used as foaming gases. Examples of such compounds are lower ethers, such as diethyl ether and diethyl ether. The propellants known from spray cans, such as propane or butane, are also suitable as foaming gases for the purposes of the present invention. The only requirement for suitability as ingredient d) is that the substance should be capable of producing voids under the processing conditions so that foam structures can be formed from the mixture of ingredients.

In preferred processes, substances gaseous at room temperature from the group consisting of carbon dioxide, nitrogen, dinitrogen oxide, propane, butane, dimethyl ether and mixtures thereof are used as blowing agents in quantities of 0.01 to 20% by weight, preferably 0.05 to 15% by weight, more preferably 0.1 to 10% by weight and most preferably 0.25 to 5% by weight, based on the weight of the solution, melt, emulsion or suspension.

Substances which release gases under the working conditions of the production process may of course also be used. Examples of such substances are sodium hydrogen carbonate, p-toluenesulfonyl hydrazide, 4,4'-oxybis-(benzenesulfonyl hydrazide) or mixtures of acids and hydrogen carbonates. Preferred processes according to the invention are characterized in that substances solid at room temperature which release gases at the extrusion temperature are used as blowing agents in quantities of 0.5 to 10% by weight and preferably in quantities of 1 to 7.5% by weight, based on the weight of the polymer or polymer mixture.

In preferred embodiments, the foams are produced by "blowing" the gaseous medium into liquids or by vigorous beating, shaking, spraying or stirring of liquid in the particular gas atmosphere. By virtue of the easier and more readily controllable and operable foaming process, foam generation by blowing in of the gaseous medium ("mechanical blowing") is distinctly preferred to the other variants in the context of the present invention. Depending on the desired process variant, mechanical blowing is carried out continuously or discontinuously using perforated plates, sintered disks, sieve inserts, Venturi nozzles, inline mixers, homogenizers or other standard systems. Self-foaming systems where the foaming gas is formed by chemical reaction of the components with one another are also preferred for the purposes of the invention. Before the foam collapses, the liquid, semiliquid or highly viscous cell walls solidify into solids so that the foam is stabilized and a "solid foam" is formed.

Solutions, dispersions, emulsions or melts may be used as the liquid to be foamed, melts being preferred for the purposes of the invention.

Alternatively, systems of relatively high viscosity up to and including plastic compositions may also be foamed. In the latter case, the mixture of ingredients a) to c) may be plasticized in an extruder and transported to the extruder outlet while being exposed to the effect of blowing agents. This process gives stable foams and does not involve melting, dissolving or dispersing the mixture of raw materials.

After their production, the foams according to the invention—depending on their composition—may be packaged and sold as ready-to-use detergents or may be blended with other constituents to form a composite detergent. In addition, open-cell foams according to the invention may serve as a carrier material for other ingredients. Thus, nonionic surfactants, perfumes, paraffin or silicone oils or other liquid substances may readily be absorbed into the foams according to the invention. The quantity of absorbed material may amount, for example, to between 20 and 1,000% by weight of additive, based on the additive-free foam.

The present invention also relates to the use of solid foams as detergent tablets or as a constituent thereof.

In other words, the present invention also relates to the use of shaped bodies consisting of gas-filled cells (pores) delimited by solid partitions as detergent tablets or as a constituent thereof. The use of these shaped bodies or constituents thereof as detergent tablets has many advantages over conventional detergent tablets. Thus, the dissolving rate can be adjusted to virtually any value which is difficult with tablets produced by conventional process technology. The tablets can also be made in any geometric shapes, including entirely new shapes which may even have overlaps that are also beyond the scope of press technology. Last but not least, the process-related advantages are considerable because the processability of foams is better by virtue of their lower viscosities compared to gels and liquids. In addition, the choice of the materials for the cell walls also provides for the production of reversibly compressible elastic structures which are readily distinguishable from competitors' products.

EXAMPLES

The mixtures identified below were processed in a 42/7 Brabender twin-screw kneader. The twin-screw kneader has contra-rotating screws which ensures extremely effective mixing. The temperatures for processing the mixtures were 140° C. in the three zones along the screw and 147° C. in the outlet die. The mixtures were extruded through a strand die at 50 r.p.m. The diameter of the die was 4 mm and the correspondingly foamed strands had a diameter of more than 5 mm (foams 1 and 2).

Foam 1.

| | |
|---|---|
| Mowiol ® 4/88 | 61.3% |
| Glycerol | 5.1% |
| Sorbitol | 5.0% |
| Aerosil ® R 972 | 0.4% |
| Stearic acid | 0.2% |
| PEG 400 | 5.0% |
| Sodium sulfate | 23.0% |

Foam 2.

| | |
|---|---|
| Mowiol ® 8/88 | 42.5% |
| Mowiol ® 4/88 | 42.5% |
| Glycerol | 4.3% |
| Sorbitol | 2.6% |
| Dist. water | 0.5% |
| Aerosil ® R 972 | 0.5% |
| Stearic acid | 0.3% |
| Sodium hydrogen carbonate | 6.8% |

Foam 3.

The processing temperatures have to be relatively high according to the blowing agent selected. In the case of foam 3, temperatures of 180-190° C. are necessary at the extruder outlet die. With temperatures as high as these, the foamed polymer then has to be quickly cooled down because otherwise it will collapse. This can be done, for example, by cooling with liquid nitrogen or other coolants in which the polyvinyl alcohol is insoluble or only poorly soluble, for example ethanol, cyclohexanol, diethylether, ethylene glycol, etc. cooled with solid carbon dioxide (mixing ratio: 30% carbon dioxide: 70% solvent).

| | |
|---|---|
| Mowiol ® 4/88 (PVA) | 78.5% |
| Glycerol | 6.9% |
| Sorbitol | 5.6% |
| Foaming agent (equimolar mixture of citric acid + sodium hydrogen carbonate) | 9.0% |

The invention claimed is:

1. A single or multiphase detergent tablet, wherein the tablet or at least one phase thereof is in the form of a solid foam comprising one or more solids and one or more gases, wherein the one or more gases comprise gas-filled cells delimited by solid partitions, and the tablet or the at least one phase thereof comprises a) 40% to 90% by weight of one or more water-soluble polymers, selected from the group consisting of:
- i) polyacrylic acids and salts thereof;
- ii) polymethacrylic acids and salts thereof;
- iii) polyvinyl pyrrolidone;
- iv) vinyl pyrrolidone/vinyl ester copolymers;
- v) cellulose ethers;
- vi) polyvinyl acetates, polyvinyl alcohols and copolymers thereof;
- vii) graft copolymers of polyethylene glycols and vinyl acetate;
- viii) alkyl acrylamide/acrylic acid copolymers and salts thereof;
- ix) alkyl acrylamide/methacrylic acid copolymers and salts thereof;
- x) alkyl acrylamide/methyl methacrylic acid copolymers and salts thereof;
- xi) alkyl acrylamide/acrylic acid/alkylaminoalkyl (meth)acrylic acid copolymers and salts thereof;
- xii) alkyl acrylamide/methacrylic acid/alkylaminoalkyl (meth) acrylic acid copolymers and salts thereof;
- xiii) alkyl acrylamide/methyl methacrylic acid/alkylaminoalkyl (meth)acrylic acid copolymers and salts thereof;
- xiv) alkyl acrylamide/alkyl methacrylate/alkylaminoethyl methacrylate/alkyl methacrylate copolymers and salts thereof;
- xv) copolymers of:
  - xiii-i) unsaturated carboxylic acids and salts thereof; and
  - xiii-ii) cationically derivatized unsaturated carboxylic acids and salts thereof;
- xvi) acrylamidoalkyl trialkylammonium chloride/acrylic acid copolymers and alkali metal and ammonium salts thereof;
- xvii) acrylamidoalkyl trialkylammonium chloride/methacrylic acid copolymers and alkali metal and ammonium salts thereof;
- xviii) methacroyl ethyl betaine/methacrylate copolymers;
- xix) vinyl acetate/crotonic acid copolymers;
- xx) acrylic acid/ethyl acrylate/N-tert.butyl acrylamide terpolymers;
- xxi) graft polymers of vinyl esters, esters of acrylic acid or methacrylic acid individually or in admixture copolymerized with crotonic acid, acrylic acid or methacrylic acid with polyalkylene oxides and/or polyalkylene glycols;
- xxii) grafted copolymers from the copolymerization of:
  - xx-i) at least one monomer that is nonionic; and
  - xx-ii) at least one monomer that is ionic;
- xxiii) copolymers obtained by copolymerization of at least one monomer of each of the following three groups:
  - xxi-i) esters of unsaturated alcohols and short-chain saturated carboxylic acids and/or esters of short-chain saturated alcohols and unsaturated carboxylic acids;
  - xxi-ii) unsaturated carboxylic acids; and
  - xxi-iii) esters of long-chain carboxylic acids and unsaturated alcohols and/or esters of the carboxylic acids of group xxi-ii with saturated or unsaturated, linear or branched $C_{8-18}$ alcohols; and
- xxiv) polyurethanes b) 10% to 60% by weight of one or more substances selected from the group consisting of builders, acidifying agents, chelating agents, scale-inhibiting polymers, and nonionic surfactants; and c) 0 to 50% by weight of one or more auxiliaries or fillers.

2. The detergent tablet of claim 1, wherein the solid partitions contain one or more substances with a melting point above 50° C.

3. The detergent tablet of claim 1, wherein the gas-filled cells have a mean diameter and the solid partitions have a mean diameter, and the mean diameter of the gas-filled cells has a ratio to the mean diameter of the solid partitions of at least 1:2.

4. The detergent tablet of claim 3, wherein the ratio of the mean diameter of the gas-filled cells to the mean diameter of the solid partitions is at least 5:1.

5. The detergent tablet of claim 4, wherein the ratio of the mean diameter of the gas-filled cells to the mean diameter of the solid partitions is at least 10:1.

6. The detergent tablet of claim 5, wherein the ratio of the mean diameter of the gas-filled cells to the mean diameter of the solid partitions is more than 20:1.

7. The detergent tablet of claim 1, wherein the gas-filled cells have a mean diameter of 0.005 mm to 5 mm.

8. The detergent tablet of claim 7, wherein the gas-filled cells have a mean diameter of 0.05 mm to 0.5 mm.

9. The detergent tablet of claim 8, wherein the gas-filled cells have a mean diameter of 0.1 mm to 0.3 mm.

10. The detergent tablet of claim 1, wherein the solid partitions have a mean diameter of 0.001 mm to 2 mm.

11. The detergent tablet of claim 10, wherein the solid partitions have a mean diameter of 0.005 mm to 0.3 mm.

12. The detergent tablet of claim 11, wherein the solid partitions have a mean diameter of 0.01 mm to 0.1 mm.

13. The detergent tablet of claim 1, wherein the gas-filled cells comprise at least 50% by volume of the tablet or the at least one phase thereof.

14. The detergent tablet of claim 13, wherein the gas-filled cells comprise at least 60% by volume of the tablet or the at least one phase thereof.

15. The detergent tablet of claim 13, wherein the gas-filled cells comprise at least 70% by volume of the tablet or the at least one phase thereof.

16. The detergent tablet of claim 1, wherein the tablet or the at least one phase thereof has a density of 0.01 $gcm^{-3}$ to 1.0 $gcm^{-3}$.

17. The detergent tablet of claim 16, wherein the tablet or the at least one phase thereof has a density of 0.05 $gcm^{-3}$ to 0.7 $gcm^{-3}$.

18. The detergent tablet of claim 17, wherein the tablet or the at least one phase thereof has a density of 0.1 $gcm^{-3}$ to 0.3 $gcm^{-3}$.

19. The detergent tablet of claim 1, wherein the gas-filled cells contain one or more gases selected from the group consisting of noble gases, carbon dioxide, nitrogen, dinitrogen oxide, oxygen, ozone, dimethyl ether, and air.

20. The detergent tablet of claim 1, wherein the solid partitions comprise one or more detergent ingredients selected from the group consisting of surfactants, builders, cobuilders, polymers, bleaching agents, bleach activators, enzymes, foam inhibitors, optical brighteners, dyes, perfumes, and disintegration aids.

21. The detergent tablet of claim 1, wherein the water-soluble polymer is a polyvinyl alcohol.

22. The detergent tablet of claim 21, wherein the water-soluble polymer is a polyvinyl alcohol with a degree of hydrolysis of 70 mol-% to 100 mol-%.

23. The detergent tablet of claim 22, wherein the water-soluble polymer is a polyvinyl alcohol with a degree of hydrolysis of 80 mol-% to 90 mol-%.

24. The detergent tablet of claim 23, wherein the water-soluble polymer is a polyvinyl alcohol with a degree of hydrolysis of 81 mol-% to 89 mol.-%.

25. The detergent tablet of claim 24, wherein the water-soluble polymer is a polyvinyl alcohol with a degree of hydrolysis of 82 mol-% to 88 mol.-%.

26. The detergent tablet of claim 21, wherein the water-soluble polymer is a polyvinyl alcohol with a molecular weight in the range from 10,000 $gmol^{-1}$ to 100,000 $gmol^{-1}$.

27. The detergent tablet of claim 26, wherein the water-soluble polymer is a polyvinyl alcohol with a molecular weight in the range from 11,000 $gmol^{-1}$ to 90,000 $gmol^{-1}$.

28. The detergent tablet of claim 27, wherein the water-soluble polymer is a polyvinyl alcohol with a molecular weight in the range from 12,000 $gmol^{-1}$ to 80,000 $gmol^{-1}$.

29. The detergent tablet of claim 28, wherein the water-soluble polymer is a polyvinyl alcohol with a molecular weight in the range from 13,000 $gmol^{-1}$ to 70,000 $gmol^{-1}$.

30. The detergent tablet of claim 1, wherein the water-soluble polymer is polyurethane of diisocyanates (I) and diols (II);

$$O{=}C{=}N{-}R^1{-}N{=}C{=}O \quad \text{(I)}$$

$$H{-}O{-}R^2{-}O{-}H \quad \text{(II)},$$

the diols being at least partly selected from polyethylene glycols (IIa) or polypropylene glycols (IIb):

$$H{-}(O{-}CH_2{-}CH_2)_n{-}OH \quad \text{(IIa)}$$

$$H{-}(O{-}CH(CH_3){-}CH_2)_n{-}OH \quad \text{(IIb)}$$

wherein $R^1$ and $R^2$ independently of one another represent a substituted or unsubstituted, linear or branched alkyl, aryl or alkylaryl group containing 1 to 24 carbon atoms, and n is a number of 5 to 2,000.

31. The detergent tablet of claim 30, wherein $R^1$ is a methylene, ethylene, propylene, butylene, pentylene, $-(CH_2)_6-$, 2,4- or 2,6-$C_6H_3-CH_3$, $C_6H_4-CH_2-C_6H_4$, or 3,5,5-trimethyl-2-cyclohexenone group, $R^2$ is $-CH_2-CH_2-(O-CH_2-CH_2)_n-$ or $CH_2-CH_2-(O-CH(CH_3)-CH_2)_n-$, and n=4 to 1999.

32. The detergent tablet of claim 30, wherein the water-soluble polymer is a polyurethane which contains structural elements corresponding to formula (IX):

$$-[O{-}C(O){-}NH{-}R^1{-}NH{-}C(O){-}O{-}R^2]_k- \quad \text{(IX)}$$

wherein $R^1$ is $-(CH_2)_6-$, 2,4- or 2,6-$C_6H_3-CH_3$, or $C_6H_4-CH_2-C_6H_4$, $R^2$ is $-CH_2-CH_2-(O-CH_2-CH_2)_n-$ or $-CH(CH_3)-CH_2-(O-CH(CH_3)-CH_2)_n-$, n=5 to 199, and, k=1 to 2,000.

33. The detergent tablet of claim 1, wherein the tablet or at least one phase thereof comprises 45% to 87.5% by weight of the water-soluble polymer(s).

34. The detergent tablet of claim 33, wherein the tablet or the at least one phase thereof comprises 50% to 85% by weight of the water-soluble polymers.

35. The detergent tablet of claim 34, wherein the tablet or the at least one phase thereof comprises 60% to 80% by weight of the water-soluble polymer(s).

36. The detergent tablet of claim 1, wherein the tablet or the at least one phase thereof further comprises 10% to 60% by weight of one or more substances selected from the group consisting of builders, acidifying agents, chelating agents and scale-inhibiting polymers.

37. The detergent tablet of claim 1, wherein the tablet or the at least one phase thereof comprises as b) 15% to 50% by weight of one or more nonionic surfactants.

38. The detergent tablet of claim 37, wherein the tablet or the at least one phase thereof comprises as b) 17.5% to 45% by weight of one or more nonionic surfactants.

39. The detergent tablet of claim 38, wherein the tablet or the at least one phase thereof comprises as b) 20% to 40% by weight of one or more nonionic surfactants.

40. The detergent tablet of claim 1, wherein the tablet or the at least one phase thereof comprises as c) one or more substances selected from the group consisting of dyes, perfumes, fillers, binders, humectants, and salts.

41. The detergent tablet of claim 2, wherein the one or more substances with a melting point above 50° C. are selected from the group consisting of paraffins, polyethylene glycols, and fatty compounds.

42. A multiphase detergent tablet according to claim 1, wherein the phases of the multiphase tablet are in the form of layers.

43. A multiphase detergent tablet according to claim 1, wherein at least one phase comprises a cavity in which another phase is at least partly embedded.

44. A multiphase detergent tablet according to claim 1, wherein one phase comprises the gas-filled cells surrounded by solid partitions, in which phase the other phase or phases are embedded.

45. The detergent tablet of claim 44, wherein a phase embedded in the phase comprising the gas-filled cells surrounded by solid partitions comprises particulate solids.

46. A multiphase detergent tablet according to claim 1, comprising a compressed phase.

47. A multiphase detergent tablet according to claim 1, comprising a non-compressed phase.

48. A multiphase detergent tablet according to claim 1, comprising a sintered phase.

49. A multiphase detergent tablet according to claim 1, comprising a cast phase.

50. A multiphase detergent tablet according to claim 1, having a weight ratio of the weight of the at least one solid foam phase to the weight of any other phases present of from 30:1 to 1:50.

51. The multiphase detergent tablet of claim 50, having a weight ratio of the weight of the at least one solid foam phase to the weight of any other phases present of from 5:1 to 1:30.

52. The multiphase detergent tablet of claim 51, having a weight ratio of the weight of the at least one solid foam phase to the weight of any other phases present of from 1:1 to 1:10.

53. A multiphase detergent tablet according to claim 1, having a ratio by volume between the at least one solid foam phase and any other phases present of from 50:1 to 1:20.

54. The multiphase detergent tablet of claim 53, having a ratio by volume between the at least one solid foam phase and any other phases present of from 10:1 to 1:10.

55. The multiphase detergent tablet of claim 54, having a ratio by volume between the at least one solid phase and any other phases present of from 5:1 to 1:5.

56. The multiphase detergent tablet of claim 55, having a ratio by volume between the at least one solid foam phase and any other phases present of from 4:1 to 1:2.

57. A multiphase detergent tablet according to claim 1, wherein the at least one solid foam phase dissolves more quickly than any other phases present.

58. The multiphase detergent tablet of claim 57, wherein at least 50% by weight of the at least one solid foam phase dissolves in the same time as at most 10% by weight of the any other phases present.

59. A multiphase detergent tablet according to claim 1, wherein the at least one solid foam phase dissolves more slowly than any other phases present.

60. The multiphase detergent tablet of claim 59, wherein at most 10% by weight of the at least one solid foam phase dissolves in the same time as at least 50% by weight of the any other phases present.

61. The detergent tablet of claim 1, wherein the solid foam comprises at least one active ingredient selected from the group consisting of enzymes, anionic or cationic surfactants, soil release polymers, disintegration aids, bleaching agents, bleach activators bleach catalysts, silver protectors, and mixtures thereof.

62. A process for the production of single or multiphase detergent tablets, wherein the tablet or at least one phase thereof is in the form of a solid foam, comprising the steps of foaming a liquid solution, melt, emulsion, or suspension comprising at least one active ingredient with a gaseous medium, said foam comprising one or more solids and one or more gases, wherein the one or more gases comprise gas-filled cells delimited by solid partitions and the tablet or at least one phase thereof comprises:

a) 40 to 90% by weight of one or more water-soluble polymers selected from a group consisting of
- i) polyacrylic acids and salts thereof;
- ii) polymethacrylic acids and salts thereof;
- iii) polyvinyl pyrrolidone;
- iv) polyvinyl pyrrolidone/vinyl ester copolymers;
- v) cellulose ethers;
- vi) polyvinyl acetates, polyvinyl alcohols and copolymers thereof;
- vii) graft copolymers of polyethylene glycols and vinyl acetate;
- viii) alkyl acrylamide/acrylic acid copolymers and salts thereof;
- ix) alkyl acrylamide/methacrylic acid copolymers and salts thereof;
- x) alkyl acrylamide/methyl methacrylic acid copolymers and salts thereof;
- xi) alkyl acrylamide/acrylic acid/alkylaminoalkyl (meth)acrylic acid copolymers and salts thereof;
- xii) alkyl acrylamide/methacrylic acid/alkylaminoalkyl (meth)acrylic acid copolymers and salts thereof;
- xiii) alkyl acrylamide/methyl methacrylic acid/alkylaminoalkyl (meth)acrylic acid copolymers and salts thereof;
- xiv) alkyl acrylamide/alkyl methacrylate/alkylaminoethyl methacrylate/alkyl methacrylate copolymers and salts thereof;
- xv) copolymers of:
  - xiii-i) unsaturated carboxylic acids and salts thereof; and
  - xiii-ii) cationically derivatized unsaturated carboxylic acids and salts thereof;
- xvi) acrylamidoalkyl trialkylammonium chloride/acrylic acid copolymers and alkali metal and ammonium salts thereof;
- xvii) acrylamidoalkyl trialkylammonium chloride/methacrylic acid copolymers and alkali metal and ammonium salts thereof;
- xviii) methacroyl ethyl betaine/methacrylate copolymers;
- xix) vinyl acetate/crotonic acid copolymers;
- xx) acrylic acid/ethyl acrylate/N-tert.butyl acrylamide terpolymers;
- xxi) graft polymers of vinyl esters, esters of acrylic acid or methacrylic acid individually or in admixture copolymerized with crotonic acid, acrylic acid or methacrylic acid with polyalkylene oxides and/or polyalkylene glycols;
- xxii) grafted copolymers from the copolymerization of:
  - xx-i) at least one monomer that is nonionic; and
  - xx-ii) at least one monomer that is ionic;

xxiii) copolymers obtained by copolymerization of at least one monomer of each of the following three groups:

xx-i) esters of unsaturated alcohols and short-chain saturated carboxylic acids and/or esters of short-chain saturated alcohols and unsaturated carboxylic acids;

xx-ii) unsaturated carboxylic acids; and xx-iii) esters of long-chain carboxylic acids and unsaturated alcohols and/or esters of the carboxylic acids of a group xxi-ii with saturated or unsaturated, linear or branched $C_{8-18}$ alcohols; and xxiv) polyurethanes b) 12.5% to 55% by weight of one or more nonionic surfactants;

c) 0 to 50% by weight of one or more auxiliaries or fillers; and d) 0.01 to 30% by weight of a foaming gas; and solidifying the resulting foam.

63. The process of claim 62, wherein the solution, melt, suspension or emulsion comprises 0.01% to 20% by weight of the foaming gas, said foaming gas comprising one or more substances gaseous at room temperature selected from the group consisting of carbon dioxide, nitrogen, dinitrogen oxide, propane, butane, and dimethyl ether.

64. The process of claim 63, wherein the solution, melt, suspension or emulsion comprises 0.05% to 15% by weight of the foaming gas.

65. The process of claim 64, wherein the solution, melt, suspension or emulsion comprises 0.1% to 10% by weight of the foaming gas.

66. The process of claim 65, wherein the solution, melt, suspension or emulsion comprises 0.25% to 5% by weight of the foaming gas.

67. The process of claim 62, wherein the solution, melt, suspension or emulsion further comprises 0.5% to 10% by weight of one or more substances solid at room temperature that release gases upon extrusion of the solution, melt, suspension, or emulsion, said weight percent being based upon the weight of component a).

68. The process of claim 67, wherein the solution, melt, suspension or emulsion comprises 1% to 7.5% by weight of one or more substances solid at room temperature that release gases upon extrusion of the solution, melt, suspension, or emulsion.

69. A process for the production of multiphase detergent tablets, according to claim 1 comprising the steps of:

a) forming at least one first shaped body comprising at least one active ingredient by one or any combination of extrusion, pelleting, tabletting, sintering, casting, injection molding, thermoforming, or rolling;

b) exposing a solution, suspension, emulsion or melt containing at least one active ingredient to a gaseous medium to form at least one second shaped body comprising gas-filled cells delimited by solid partitions; and c) combining the shaped bodies produced in steps a) and b) to form a multiphase detergent tablet.

70. The process of claim 69, wherein step c) comprises combining the shaped bodies produced in steps a) and b) by applying a coupling agent or agents to one or more surfaces of at least one of the shaped bodies produced in one of step a) or b) and contacting the surface of the shaped body having the coupling agent or agents applied with a surface of a shaped body produced by the other of step a) or b).

71. The process of claim 69, wherein more than one non-foamed shaped bodies are joined to one or more foamed shaped bodies.

72. A process for the production of multiphase detergent tablets, according to claim 1 comprising the steps of:

a) exposing a first solution, suspension, emulsion or melt containing at least one active ingredient to a gaseous medium to form one or more shaped bodies comprising gas-filled cells delimited by solid partitions;

b) exposing a second solution or melt containing at least one active ingredient to a gaseous medium to form one or more shaped bodies comprising gas-filled cells delimited by solid partitions; and c) combining the shaped bodies produced in steps a) and b).

73. The process of claim 72, wherein the shaped bodies formed in steps a) and b) have differing compositions.

74. The process of claim 72, wherein the shaped bodies produced in steps a) and b) comprise different active ingredients.

75. The process of claim 74, wherein the shaped bodies produced in steps a) and b) have identical compositions.

76. The process of claim 72, wherein the shaped bodies produced in steps a) and b) have different mean pore sizes.

77. The process of claim 72 characterized by the further step of incorporating particulate solids in the shaped bodies formed in step a) and/or b).

78. The process of claim 77, wherein the solids incorporated in step a) and/or b) comprise granules, agglomerates, extrudates, compactates, or pellets having particle sizes of 400 to 3,000 μm.

79. The process of claim 78, wherein the particles have sizes of 600 to 2,500 μm.

80. The process of claim 79, wherein the particles have sizes of 800 to 2,000 μm.

81. The process of claim 77, wherein the solids incorporated in step a) and/or b) have particle sizes of 50 to 600 μm.

82. The process of claim 81, wherein the solids incorporated in step a) and/or b) have particle sizes of 100 to 500 μm.

83. The process of claim 82, wherein the solids incorporated in step a) and/or b) have particle sizes of 200 to 400 μm.

* * * * *